United States Patent [19]

Johnson et al.

[11] 4,124,285

[45] Nov. 7, 1978

[54] MARKER PROJECTOR SYSTEM

[75] Inventors: Gerald L. Johnson; Joe T. Huff, both of Garland; Weldon A. Sanders, Jr., Seagoville, all of, TX

[73] Assignee: Levi Strauss & Co., San Francisco, Calif.

[21] Appl. No.: 799,216

[22] Filed: May 23, 1977

[51] Int. Cl.[2] ..... A41L 3/00; G03B 21/26

[52] U.S. Cl. ..... 353/28

[58] Field of Search ..... 356/200, 156; 353/28, 353/121, 122; 33/11, 17; 26/70

[56] References Cited

U.S. PATENT DOCUMENTS

| | | | |
|---|---|---|---|
| 2,973,688 | 3/1961 | Bilibok | 33/11 X |
| 3,277,780 | 10/1966 | Hartwig | 353/5 |
| 3,540,830 | 11/1970 | DiCanio | 353/28 X |
| 3,734,605 | 5/1973 | Yevick | 353/27 R |
| 3,750,290 | 8/1973 | Stengle | 33/11 X |

*Primary Examiner*—Harry N. Haroian

*Attorney, Agent, or Firm*—Limbach, Limbach & Sutton

[57] ABSTRACT

As textile fabric is spread from a roll onto a cutting table, in stacked layers, the cutting pattern is selectively projected by the apparatus of the invention onto the unrolled fabric wherever a fabric flaw is known to exist to enable the operator to determine, prior to attaching a corresponding paper pattern to the spread fabric, whether or not the flaw will otherwise be present in an area to be cut out according to the pattern. The pattern projecting apparatus is mechanically and electronically coordinated with the fabric spreading apparatus and as the projecting apparatus scans across the width of the unrolled fabric, the projected image appears to the operator to be stationary on the fabric and is properly located longitudinally and transversely on the fabric with respect to the pattern which is ultimately to be cut out.

4 Claims, 45 Drawing Figures

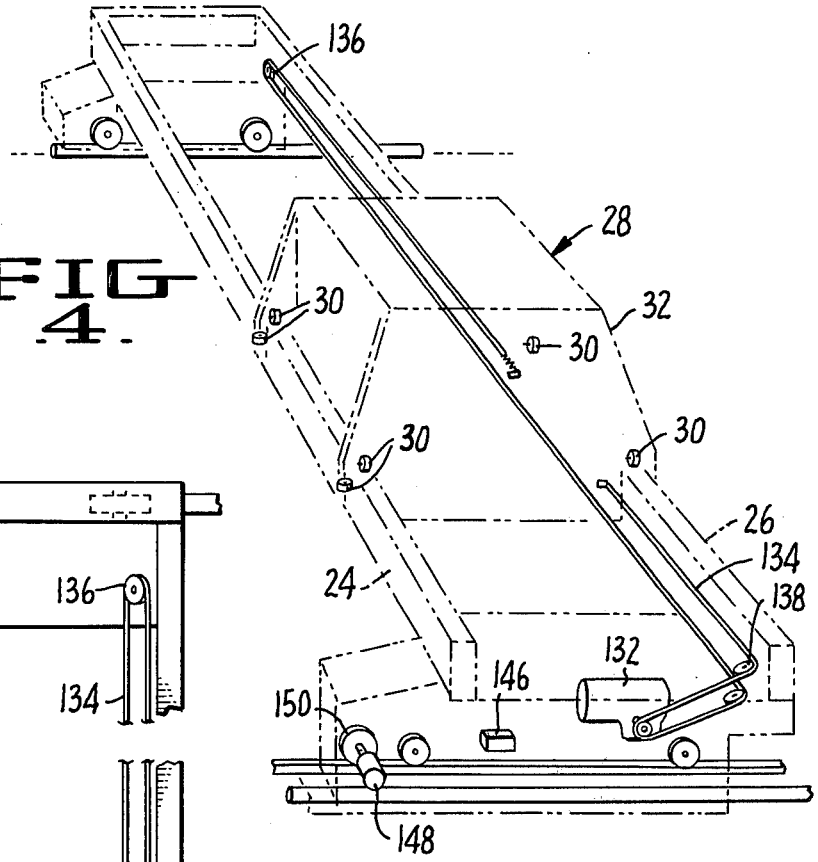
FIG. 4.
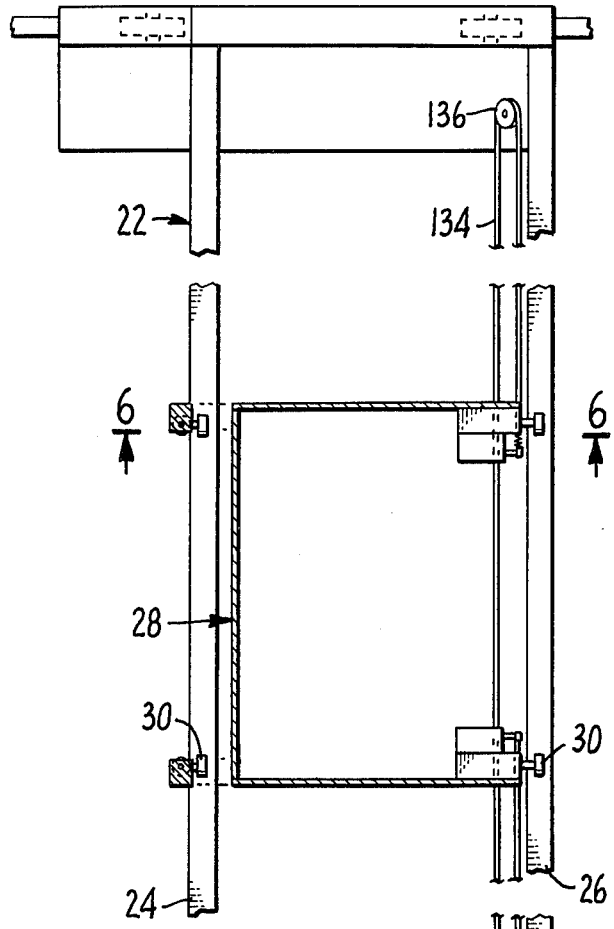
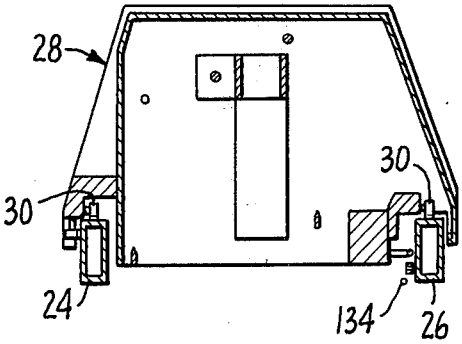
FIG. 6.
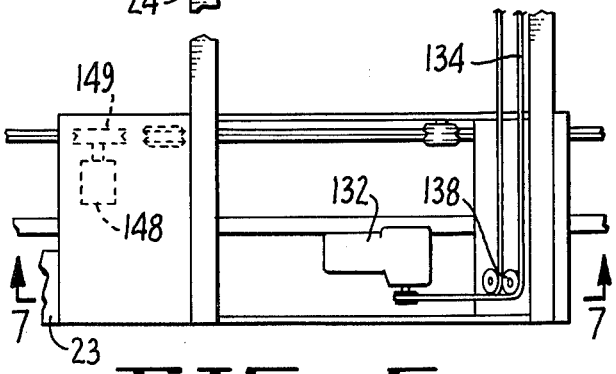
FIG. 5.
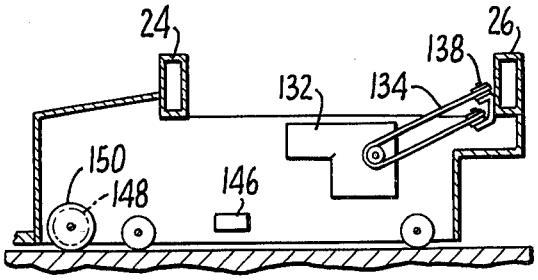
FIG. 7.

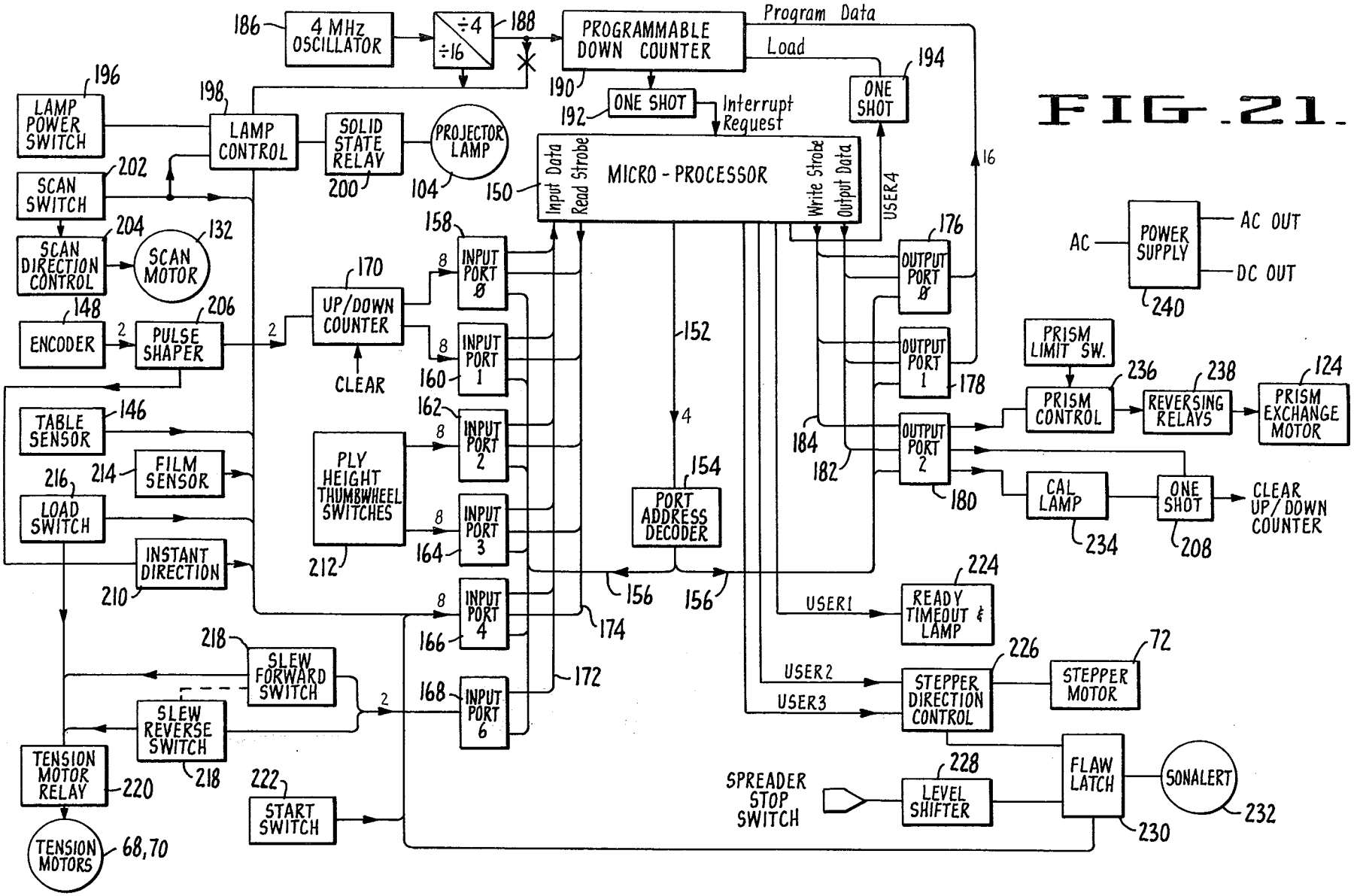
FIG. 21.
AC
AC OUT
DC OUT
POWER SUPPLY
240
PRISM LIMIT SW.
236
PRISM CONTROL
REVERSING RELAYS
238
PRISM EXCHANGE MOTOR
124
CAL LAMP
234
ONE SHOT
208
CLEAR UP/DOWN COUNTER
STEPPER MOTOR
72
SONALERT
232
FLAW LATCH
230
OUTPUT PORT 8
176
OUTPUT PORT 1
178
OUTPUT PORT 2
180
READY TIMEOUT & LAMP
224
STEPPER DIRECTION CONTROL
226
LEVEL SHIFTER
228
SPREADER STOP SWITCH
USER1
USER2
USER3
USER4
16
ONE SHOT
194
Program Data
Load
Interrupt Request
Write Strobe
Output Data
MICRO - PROCESSOR
Input Data
Read Strobe
182
184
152
4
154
PORT ADDRESS DECODER
156
174
172
PROGRAMMABLE DOWN COUNTER
190
ONE SHOT
192
150
188
÷4
÷16
PROJECTOR LAMP
104
INPUT PORT 8
158
INPUT PORT 1
160
INPUT PORT 2
162
INPUT PORT 3
164
INPUT PORT 4
166
INPUT PORT 6
168
4 MHz OSCILLATOR
186
SOLID STATE RELAY
200
UP/DOWN COUNTER
170
CLEAR
PLY HEIGHT THUMBWHEEL SWITCHES
212
SLEW FORWARD SWITCH
218
START SWITCH
222
LAMP CONTROL
198
SCAN MOTOR
132
PULSE SHAPER
206
FILM SENSOR
214
INSTANT DIRECTION
210
SLEW REVERSE SWITCH
218
LAMP POWER SWITCH
196
SCAN SWITCH
202
SCAN DIRECTION CONTROL
204
ENCODER
148
TABLE SENSOR
146
LOAD SWITCH
216
TENSION MOTOR RELAY
220
TENSION MOTORS
68,70

MPS SOFTWARE BLOCK DIAGRAM

MARKER PROJECTOR SYSTEM

BACKGROUND OF THE INVENTION

In the fabrication of garments, one of the first steps is to spread the fabric to be sewn into the garment from a roll into long lengths on a cutting table. The lengths of fabric are unrolled first in one direction and then the roll is reversed and the fabric is laid upsidedown on the previous layer as it is unrolled in the opposite direction. This process is continued until a stack of layers of a predetermined height is obtained. At this point, a pattern is unrolled on top of the stack and the garment pieces are simultaneously cut out from all of the underlying layers beneath the pattern. It sometimes happens that a defect or flaw in the fabric will coincide with one of the pieces to be cut out in forming the garment. In order to prevent this, the worker, as the roll of fabric is unrolled, must inspect the fabric and at each point where a flaw occurs he must cut out the flaw and overlap the fabric and continue with the spreading operation. This is both time consuming and is a waste of materials since the flaw will often not coincide with one of the pieces to be cut out of the fabric to form the garment. It has now become possible to automatically inspect fabric as it is originally placed on the rolls and to mark the locations of flaws in a roll of fabric along the selvedge with either a metallic tape or with fluorescent ink which can be automatically detected upon the unrolling of the fabric. While this aids the operator in locating the flaws, it does not help him determine the position of those flaws with respect to the pattern.

Previous attempts to obviate this problem have included a mechanism which attaches to the fabric spreading machine and which carries a miniature marker, or pattern, in a loop which stays in registration with the corresponding position with the actual marker on the cutting table. The device is geared to the spreading machine to maintain exact position of the marker loop with regard to the spread fabric. The defect of this type of approach is that it does not show the actual registration of the flaw in the fabric with respect to the marker.

SUMMARY OF THE INVENTION

The above and other problems of correlating flaws in fabric to be spread with the pattern to be cut out of the fabric are overcome by the present invention of apparatus for projecting a pattern onto a continuous length of fabric, the projecting apparatus comprising a first carriage for traversing the length of the material, a second carriage carried by the first carriage for traversing the width of the material, an image medium carried by the second carriage, the image medium having an image of the pattern to be projected, and an image projector carried by the second carriage for selectively projecting a portion of the pattern as represented by the image medium onto the material. Image medium transport means, carried by the second carriage and operatively connected to it, index the image medium with respect to the image projector so that the image projected onto the material by the projector appears to the operator to be stationary with respect to the material as the second carriage is moved across the material.

In the preferred embodiment of the invention, the image medium transport means include means for sensing discrete locations on the material, representative, for example, of its length, relative to the travel of the first carriage in the first direction and means for selectively indexing the image medium in correspondence with the sensed discrete locations. In this way, the image medium is selectively advanced in correspondence with the advancement of the spreading apparatus as it moves along the length of the cutting table in spreading the material.

In order to compensate for the fact that the material is spread in one layer face down and the next layer face up, the image projecting means further includes optical means for reversing the projection with respect to the direction of travel of the second carriage whereby the pattern can be sequentially projected in aligned fashion on each layer of a stack of layers of the material as they are laid alternately face up and face down. This image projector means includes an amici prism which reverses the image in only one direction.

In operation, the system of the present invention provides a means by which a spreader operator can quickly and accurately determine the correlation of a defect on a vertical drop of material to its position in the marker, that is the pattern to be cut out, during the spreading process. Thus, defects in the fabric can be immediately referenced to the marker to determine if it will show on a finished garment or if it falls in a hidden area or in the fabric scrap area. The fabric has been previously inspected by automatic fabric inspection apparatus of the type described in U.S. Pat. No. 3,841,761. At each location of a detected flaw, a mark is made in the selvage of the material. The marker projector system of the present invention is attached to the fabric spreading apparatus and as the spreading operation is in progress, an optical scanner on the marker projector system gives an audible or visual signal to the operator of the presence of a defect which it has detected by means of the mark on the fabric. In some embodiments, the defects in the fabric are noted by a special reflective tape which is sensed by an optical scanner in the marker projector system. (See U.S. Pat. No. 3,962,730). In the preferred embodiment, the marker projector system automatically stops the motorized fabric spreader. The operator then moves the image projector means by moving the second carriage across the width of the spreading table and the fabric until the projector means illuminates the area of the cloth that contains the defect.

When the projector means is projected in front of the defect the portion of the full size marker appropriate for that area of the fabric is displayed on the fabric. The operator is then visually able to evaluate the position and the seriousness of the defect relative to the marker.

The apparatus of the present invention rides on its own set of wheels on the spreader table and is attached to a motorized spreader. The apparatus thus derives its locomotion along the table from the motorized spreading machine. The spreading apparatus is conventional and carries a bolt of fabric on rollers above the spreading table and allows a length of fabric to drop vertically to the table where it is laid flat on the table. The projector system of the present invention illuminates a full size image of a portion of the marker onto this vertical drop of cloth.

The means for indexing the image medium comprise mechanical drives, electronic interfaces, and microprocessor programs which are required to allow the film or image medium in the system to coincide with the marker as if it were placed onto the cutting table. The correct position of the image medium transport means is determined by a micro-processor. The micro-processor is programmed to accept certain inputs and deliver certain output signals as described hereinafter. The spreading table has marks along its length that represent the positions of the individual markers which make up a continuous length carried by the image medium transport means. These marks are sensed by the apparatus of the invention. The image medium, which represents the marker scaled down by one fifth of its original size, also has marks along its length which the apparatus of the invention detects. During an initialization run, the micro-processor stores the information derived from the marks on the tables in the form of encoder inputs, i.e. pulses acquired by moving the mechanism down the length of the table. At the completion of the initialization run, the micro-processor causes the image medium transport means to index the image medium through its entire length, noting the marks on the image medium as the image medium passes through the projector means. If the number of marks on the image medium conincide with the number of marks detected from the spreading table, the program in the micro-processor outputs a "ready" signal to a control panel. Any movement of the fabric spreader and marker projector apparatus thereafter is detected by the encoder of the system and is inputted to an up/down counter. The micro-processor monitors this interface at very short time intervals. By knowing the number of marks, the number of marks detected along the table, and the encoder count, the major direction of travel along the table is known to the micro-processor. This information is used to determine which prism is to be used in the image medium projector means and which offset is required by the image medium indexing means to display the image correctly. The image medium indexing means is brought into action only when requested by manual operation of a scan drive switch. At this time, the micro-processor makes all of its adjustments. Errors can be corrected by the micro-processor by comparing the initialization run with where the marks appear to be at the time the scan drive switch is actuated.

The image medium indexing means is basically a stepping motor driving the image medium, which is a type of film, by means of a sprocketed tube driver. Stalled, shaded, pole motors operating in opposite directions provide the take-up torque to the film reels.

In order to give the appearance of a stationary projection of the film, the second carriage moves across the projector table in a forward or a reverse direction while simultaneously, by a one fifth gear reduction in speed, the projector means in the second carriage moves in the opposite direction. Because of the one fifth gearing and the fact that the image medium is one fifth scale, the net result is that the image projected onto the fabric appears to be stationary to the operator despite the fact that the second carriage is moving across the width of the fabric.

It is therefore an object of the present invention to provide a means by which a spreader operator can quickly and accurately determine the correlation of the position of a defect on a fabric lay with respect to the marker during the spreading process.

It is another object of the invention to provide means for projecting a marker pattern onto a layer of fabric to be spread at discrete locations selected by the spreader operator to correlate the pattern with the fabric flaws.

It is still another object of the invention to provide means attached to a spreader machine for projecting a marker pattern onto a layer of fabric to be spread.

It is another object of the invention to provide means for projecting a marker pattern onto a layer of fabric to be spread whether the layer is spread face up or face down.

The foregoing and other objectives, features and advantages of the invention will be more readily understood upon consideration of the following detailed description of certain preferred embodiments of the invention, taken in conjunction with the accompanying drawings.

BRIEF DESCRIPTION OF THE DRAWINGS

FIG. 4 is a diagrammatic, perspective view of the drive mechanism for the marker projector system of the present invention;

FIG. 5 is a horizontal, diagrammatic, sectional view with portions broken away, of the drive and transport system for the marker projector system viewed in FIG. 4;

FIG. 6 is a vertical, sectional, diagrammatic view, taken generally along the lines 6—6 in FIG. 5;

FIG. 7 is a vertical, sectional, diagrammatic view, taken generally along the lines 7—7 in FIG. 5;

FIG. 21 is a block diagram of the electronic control system for the marker projector system according to the invention;

DETAILED DESCRIPTION OF CERTAIN PREFERRED EMBODIMENTS

Figure 1:
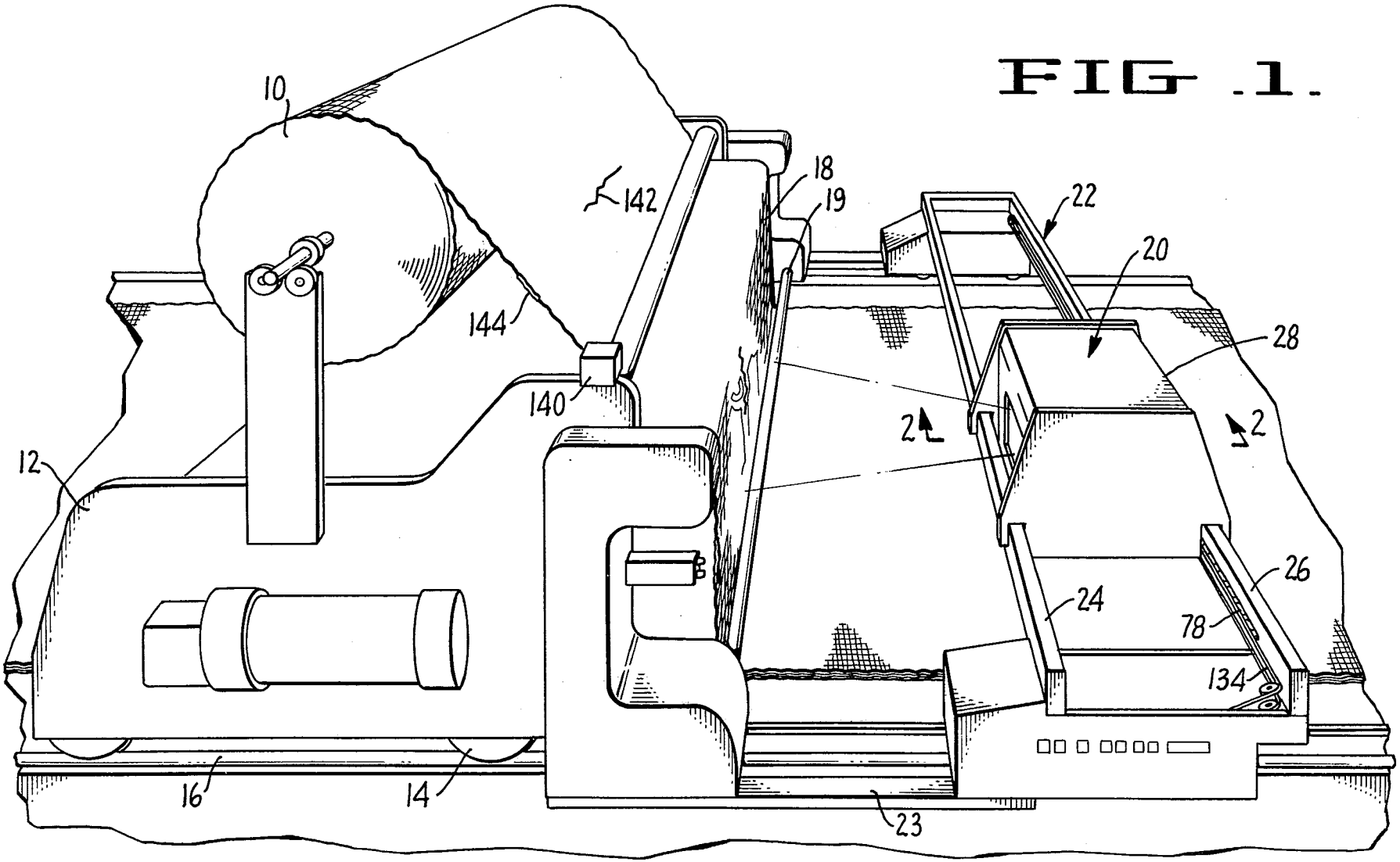
FIG. 1 is a perspective view of a marker projector system and spreader device according to the invention.

Referring now more particularly to FIG. 1, the arrangement of the marker projector system of the invention together with a motorized fabric spreader is illustrated. A bolt of cloth 10 is rotatably carried in a motorized fabric spreader 12 which rolls on wheels 14 along a spreading table 16. Since such motorized spreaders are well known to those skilled in the art, no further description of it will be given. Such spreaders are typically able to run the length of the table 16 in either direction under the manual control of an operator who is able to maneuver the spreader by means of control switches. With each pass along the length of the table 16 a layer of the fabric of the bolt 10 is laid down. It will be appreciated that in reversing direction, the layer of fabric will be laid with opposite sides facing up from layer to layer. When the fabric faces are the same on both sides, this makes no difference, however, most fabrics do have an outward face side and an inward face side, such as some denim material.

The fabric after it leaves the bolt 10, drops in a vertical fall 18 down to the spreading table 16 where it passes between a pair of bars 19, only one of which is shown in FIG. 1, before it actually contacts the surface of the table 16. The marker projector system 20 of the invention is mounted on a first wheeled carriage 22 which rides along the surface of the spreading table 16 and which is attached to the motorized spreader by means of braces 23. In this way, the first carriage 22 derives its locomotion from the movement of the motorized spreader 12. The carriage 22 supports a second carriage 28 transversely with respect to the length of the table 16 by means of a pair of parallel, spaced apart, horizontal rails 24 and 26 which span the width of the spreading table 16. As will be explained in greater detail hereinafter, the marker projector of the invention is contained within the housing of the second carriage 28 and projects an image of the pattern, which is ultimately to be cut from the spread fabric, onto the vertical drop 18 of the fabric as it leaves the spreader.

Figure 2:
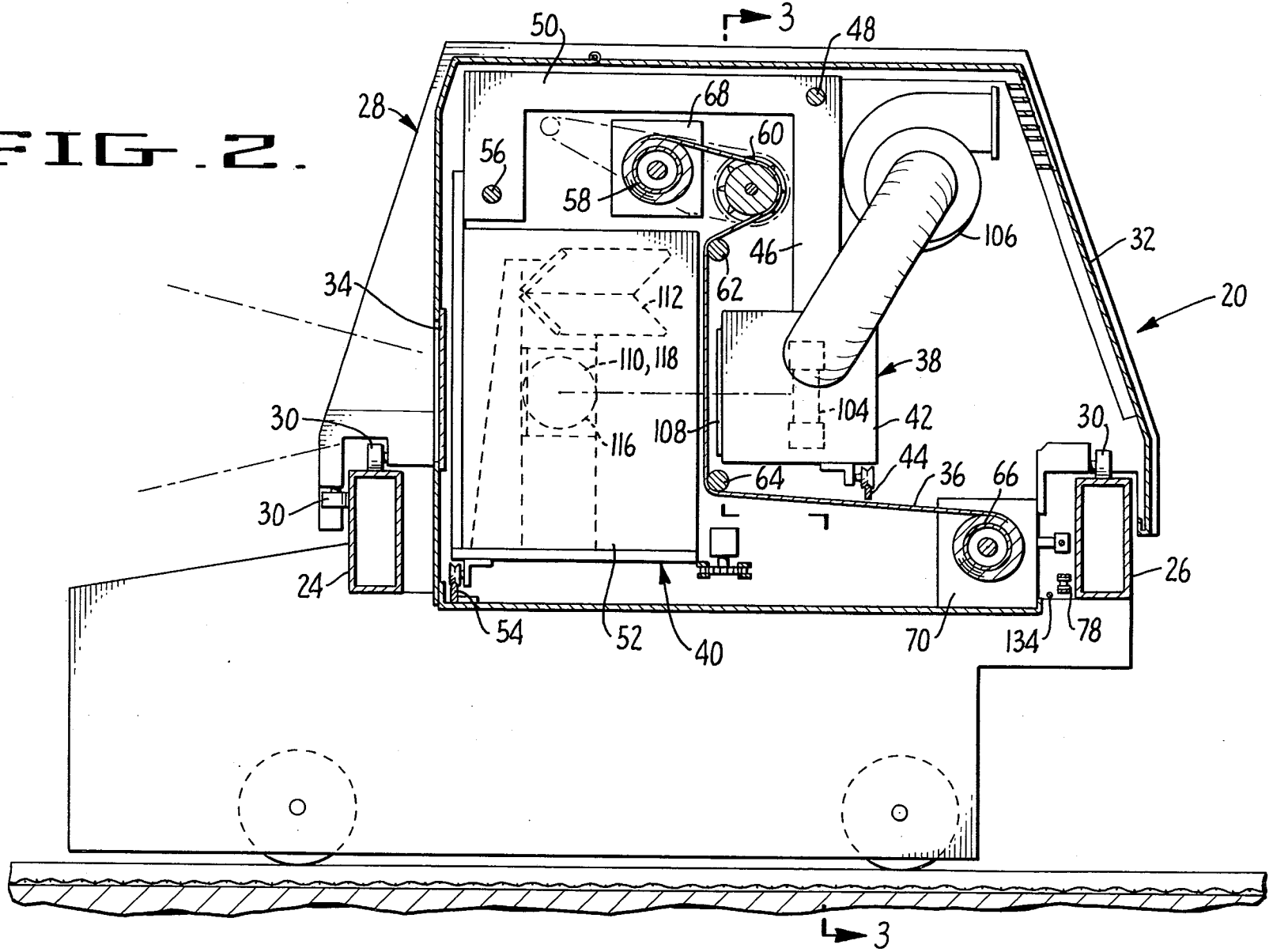
FIG. 2 is an enlarged, vertical, sectional view taken generally along the lines 2—2 of FIG. 1.
Figure 3:
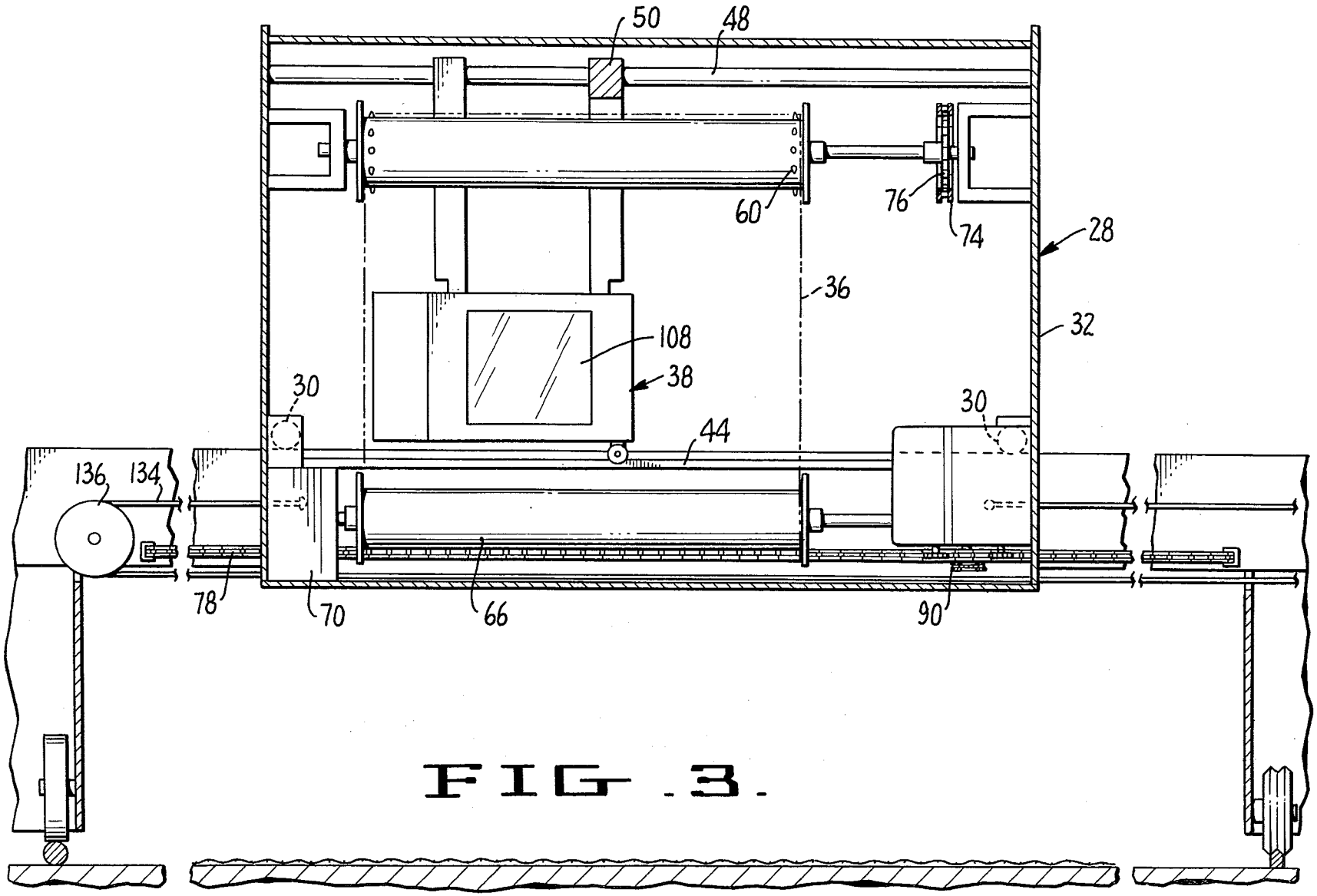
FIG. 3 is an enlarged, vertical view taken generally along the lines 3—3 of FIG. 2.

Referring now more particularly to FIG. 2, the details of the marker projector device 20 will be described. The marker projector system 20 is contained within a housing 32 mounted on the carriage 28. The carriage 28 translates upon the rails 24 and 26 by means of supporting rollers 30 mounted on the housing 32. The side of the housing facing the fall 18 of the cloth is provided with a projection window 34 through which the image is projected. The projected image is generated by shining a light source 38 through a portion of a continuous length of film 36 to produce an image which is focused through the window 34 by means of an optical system 40 on the opposite side of the film 36 from the light source 38. The details of the optical system 40 will be explained hereinafter. The light source 38 is contained within a housing 42 which translates by means of a roller along a horizontal rail 44 which extends parallel to the rails 24 and 26 within the housing 32. The translation of the housing 42 is stabilized by means of a vertical support 46 whose upper end slides along a horizontal rod 48 which is parallel to the rail 44 and which is mounted within the housing 32. A bracket 50 is attached to the vertical support member 46 and connects it to the housing 52 of the optical system 40. The housing 52 translates by means of a roller along a horizontal rail 54 mounted at the bottom left-hand edge of the housing 32, as viewed in FIG. 2. The housing 52 is stabilized in this translation by means of a horizontal bar 56 which is above the housing 52 and which passes through the bracket 50. The bar 56 is mounted within the housing 32 and is parallel to the bar 48 and the rail 44. In this way, the light source 38 and the optics 40 move simultaneously in a horizontal direction parallel to the direction of the rails 24 and 26 in scanning across the width of the film strip 36. The mechanism by which the light source and the optics are caused to translate will be explained in greater detail hereinafter.

Figure 8:
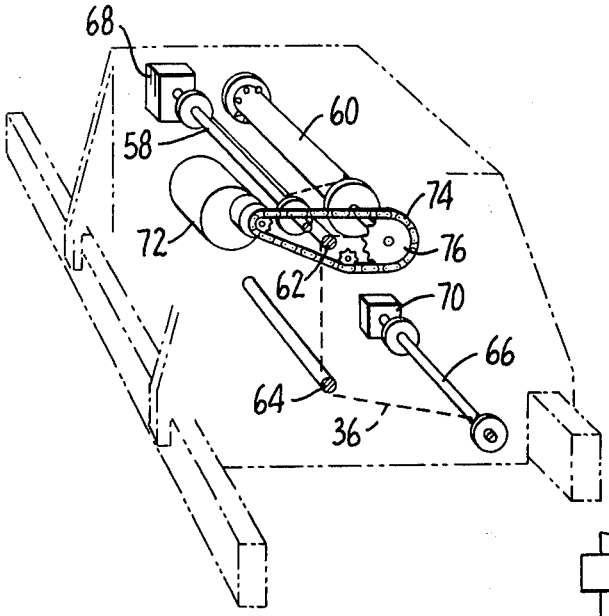
FIG. 8 is an enlarged, diagrammatic, perspective view of the film transport drive system of the marker projector system according to the invention.
Figure 9:
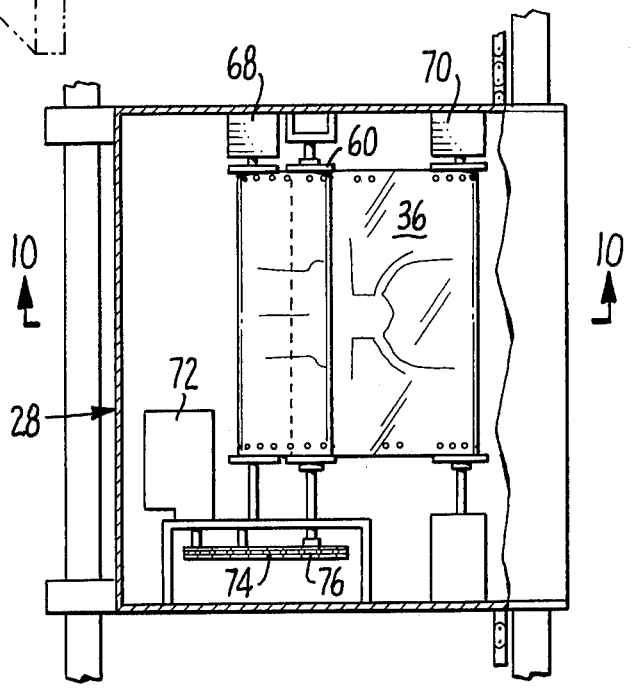
FIG. 9 is a horizontal, diagrammatic, view of the film transport drive system according to the invention.
Figure 11:
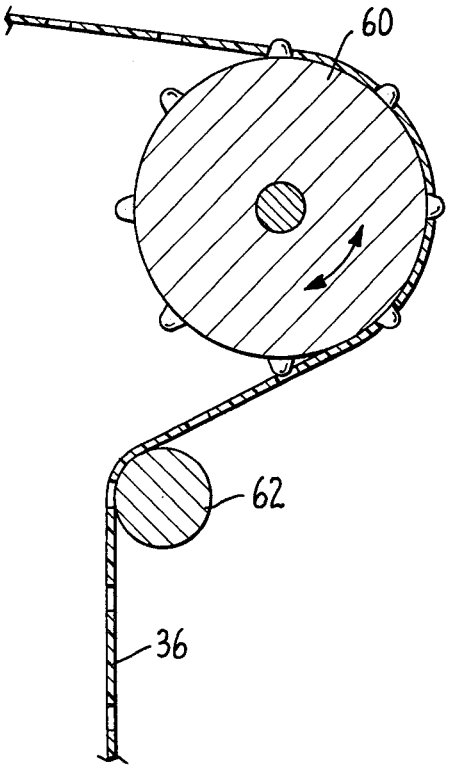
FIG. 11 is an enlarged, sectional view of the tube sprocket of the film drive system according to the invention.
Figure 10:
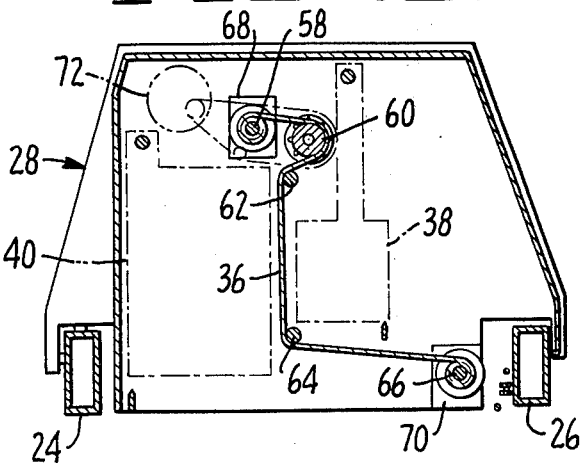
FIG. 10 is a vertical, sectional view taken generally along the lines 10—10 in FIG. 9.
Figure 12:
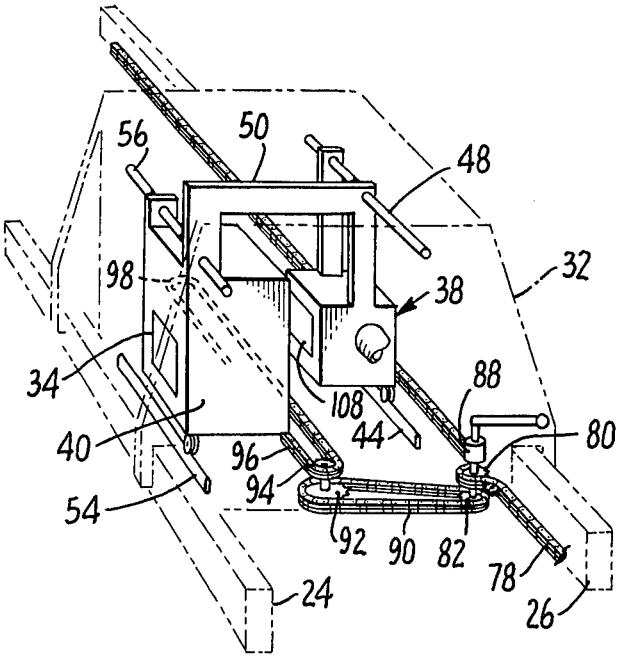
FIG. 12 is an enlarged, perspective view of the transport mechanism for the image projector of the marker projector system according to the invention.

The film strip 36 is wound at its opposite ends onto film reels. The first film reel 58 is located above the optics housing 40. The film unwinds from the reel 58 in a clockwise direction and passes over and around a sprocketed tube driver 60, around, in a counter-clockwise direction, a roller 62, straight down vertically between the optics housing 40 and the light source 38, around and underneath a bottom roller 64, and clockwise onto a second film reel 56. The terms clockwise and counterclockwise are taken with respect to the film in a stationary position and refer to the direction of curl of the film itself. All of the reels 58, 66, and the tube driver 60 and the rollers 62 and 64 are parallel to each other and extend horizontally and are rotatably mounted within the housing 32. The reels 58 and 66 are turned in opposite directions by stalled, shaded pole motors 68 and 70, respectively, to provide a constant tension on the film. Film strip 36 is actually indexed by the rotation of the sprocketed tube drive 60. The sprocketed tube driver 60 is indexed by means of a stepping motor 72, best shown in FIG. 8. The capstan gear of the stepping motor 72 drives a timing chain 74 which is entrained about a gear 76 which is mounted on the shaft of the sprocketed tube driver 60. As will be explained in greater detail hereinafter, the stepping motor 72 is operated under the control of a microprocessor to index the film 36 to the proper point along the length of the film corresponding to the length of the pattern at a particular location of the marker projector system along the spreading table 16. The stepping motor 72 is not energized to continuously step the film 36 through its length, but instead, the motor remains passive until the spreader is automatically stopped at a discrete location along the spreading table 16 corresponding to the location of a flaw in the fabric which has been detected. At this point, the operator pushes an appropriate control switch as will be described in greater detail hereinafter, to cause the microprocessor to energize the stepping motor 72 by a sufficient number of pulses of electrical current to index the strip of film 36 to the appropriate point corresponding to the location of that portion of the cut-out pattern which will overlie the flaw in the fabric along the spreading table 16.

Referring now more particularly to FIGS. 12, 13, 14 and 15, the mechanism by which the image projected from the film 36 onto the vertical drop 18 of the fabric is caused to appear stationary to the operator as the second carrirge 28 is moved across the rails 24 and 26 will now be described.

A relatively straight timing chain 78 extends along the inside length of the rail 26, that is, on the side of the rail 26 which faces the rail 24. This chain 78 extends along substantially the entire length of the rail 26. The chain is in contact with a sprocket gear 80 which is rotatably mounted within the housing 32 of the second carriage 20. Thus the movement of the second carriage 20 along the rail 26 causes the sprocket 80 to be rotated. The sprocket 80 is mounted on a sleeve 86 which is coupled to a shaft 84, contained coaxially within it, by means of a hand-operated clutch 88. A sprocket gear 82 on the end of the shaft 84 has a sprocket chain 90 entrained about it. The chain 90 is entrained around a second sprocket gear 92 which is rotatably mounted within the housing 32. Still another sprocket gear 94 is coupled to the sprocket gear 92 to rotate with it. The sprocket gear 94 drives a sprocket chain 96 whose other end is entrained around still another sprocket gear 98 at the opposite side of the housing 32 from the sprocket gear 94. The sprocket gears 94 and 98 are aligned with the plane of the film strip 36 as it passes between the housings 42 and 52 of the optical projection source 38 and the optical system 40. The housing 52 of the optical system 40 is attached to the side of the sprocket chain 96 which is closest to the housing 52.

Figure 13:
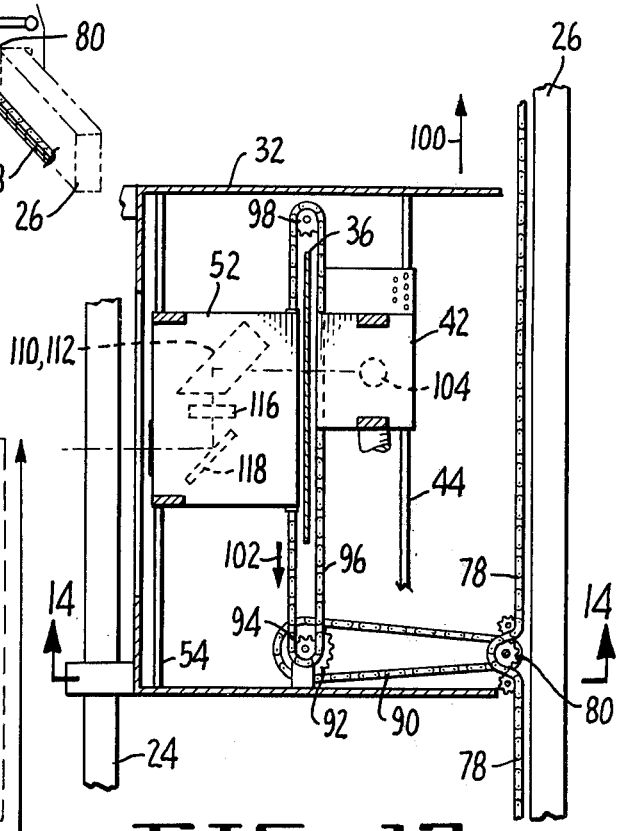
FIG. 13 is a horizontal, sectional view with portions broken away of the image projector system depicted in FIG. 12.

As is perhaps best seen in FIG. 13, as the carriage 20 moves in one direction, for example, in the direction indicated by the arrow 100, the light source 38 and the optical system 40, contained in the housings 42 and 52, respectively, move in the opposite direction as indicated by the arrow 102, due to the interaction of the sprocket gears and chains 78–98, inclusive. The purpose of the clutch 88 is to align the system at one side so that the optical system and light source are at the full extent of their travel when the carriage 20 is positioned at the edge of the vertical fall of the fabric 18. The movement of the carriage 20 is controlled by cables and a motor, as will be explained in greater detail hereinafter.

The light projection source 38 contains a bright projection lamp 104, such as a 500 watt lamp. A blower 106 cools the light projector housing 42. The side of the housing 42 which faces the strip of film 36 is provided with a transparent window 108. Contained within the housing 42, although not shown, are condensing optics which pick up as large a light cone as possible from the lamp 104 and then project all of the light beam through the window 108 and the film 36 with a minimum amount of spherical aberation. To protect the optics and the film 36, a heat absorbent filter (not shown) is placed in the optical axis within the housing 42.

Figure 17:
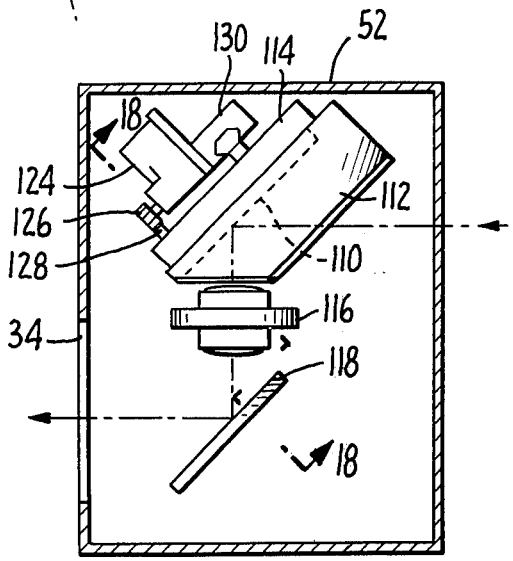
FIG. 17 is an enlarged, horizontal, sectional view of the image inverting mechanism depicted in FIGS. 15 and 16.

Referring now more particularly to FIG. 17, the optics contained within the optical system 40 will be explained in greater detail. The light from the lamp 104 which shines through the film strip 36 forms an optical image which is reflected by either one of two mirrors 110 or 112 which are spaced one above the other, respectively, and is then reflected through a lens 116 to a mirror 118 which reflects the image out of the window 34 in the housing 52. The mirrors 118, 112 and 110 are aligned with respect to each other in periscope fashion so that the axis of the light image passing from the optical source 38 is parallel to the axis of the light image leaving the window 34 but offset from it horizontally. The mirrors 110 and 118 are flat and extend in parallel, vertical planes. The mirror 112 is V-shaped, with the axis of symmetry of the V being in a horizontal plane. This type of mirror is known as an Amici mirror. Its purpose will be explained in greater detail hereinafter, but it is fundamentally to provide a way of inverting the image about a horizontal axis for alternate layers of spread fabric. The mirrors 110 and 112 are mounted on a vertically adjustable rack assembly 114.

Figure 15:
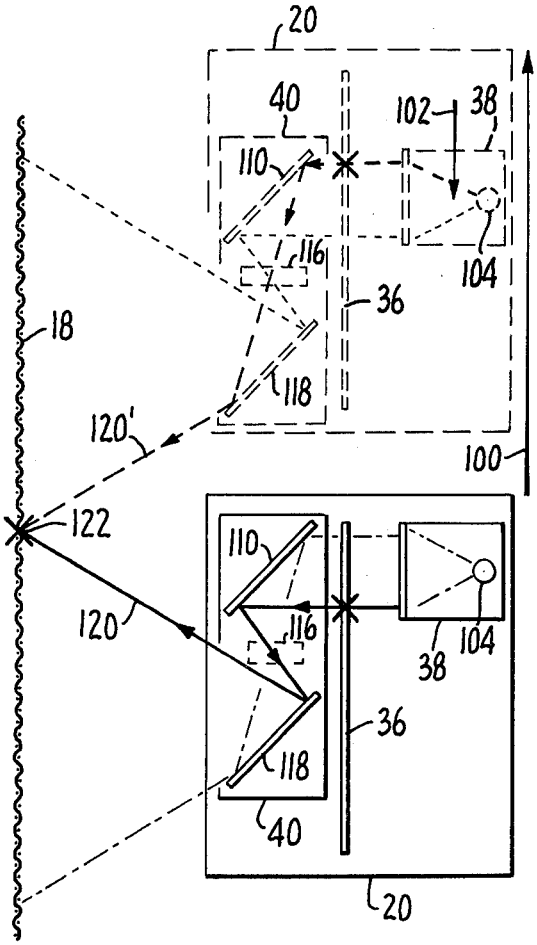
FIG. 15 is a diagrammatic view of the mechanism of the image projector for inverting the image on alternate runs of the spreader.
Figure 14:
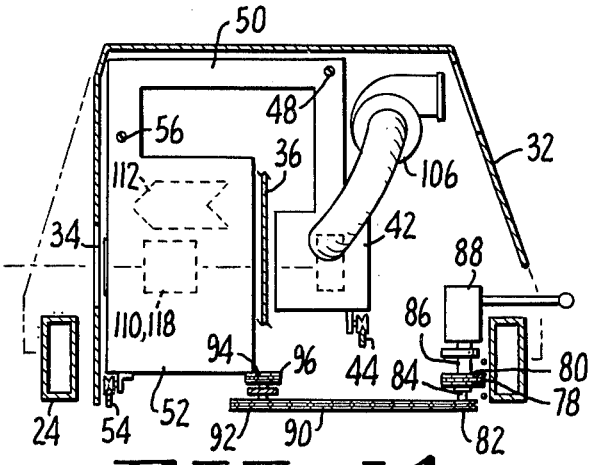
FIG. 14 is a vertical, sectional view taken generally along the lines 14—14 in FIG. 13.

Referring now more particularly to FIG. 15, it will be seen that a light ray, for example, the light ray 120, passing through a particular spot "X" on the film strip 36 will be reflected by the mirrors 110 and 118 to a predetermined spot 122 on the vertical fall 18 of the fabric. As the second carriage 20 moves in the direction of the arrow 100 the illumination source 38 and the optical system 40 move in the opposite direction as indicated by the arrow 102. The light ray passing through the same spot "X" on the film strip 36, however, now designated as 120', will be reflected by the mirrors 110 and 118 to the same spot 122 on the vertical drop of the cloth 18. This result takes place because the gearing ratio of the gears 80, 92, 94 and 98 taken together with the scale of the picture on the film 36 is such that for every incremental unit of distance traveled by the carriage 20 across the width of the spread fabric, the light source 38 and optical system 40 will move in a direction and by a distance as far in the opposite direction across the film 36 which corresponds in scale to the equivalent distance on the actual pattern to be cut out from the fabric. This gives an apparent display to the operator which is stationary. That is, the projected image point 122 does not move across the width of the fabric drop 18 as the carriage 20 is moved across the rails 24 and 26. The gearing ratio and scale in the preferred embodiment is one fifth.

Referring now more particularly to FIGS. 16, 17, 18, 19 and 20, the purpose of the amici mirror 112 will be explained. When the spreader 12 completes a run on the spreading table 16, it then reverses direction and spreads a new layer of fabric on top of the previously spread layer. The layers of fabric are thus laid alternately face-up and face-down. Fabric such as denim and corduroy, for example, have a particular face which will be observable in the sewn garment. The opposite face will not be visible. The pattern laid out on the fabric is cut out with respect to which way the layer of fabric is facing. Since most garments can be cut symmetrically, however, it is possible to cut both the left and then right sides of the garment simultaneously by cutting the pieces from the face-up and face-down layers of fabric. The pieces which are laying face-up when they are cut will be, for example, the right side pieces of the garment, whereas the layers of fabric pieces which are laying face-down will be, for example, the left side of the garment.

Figure 16:
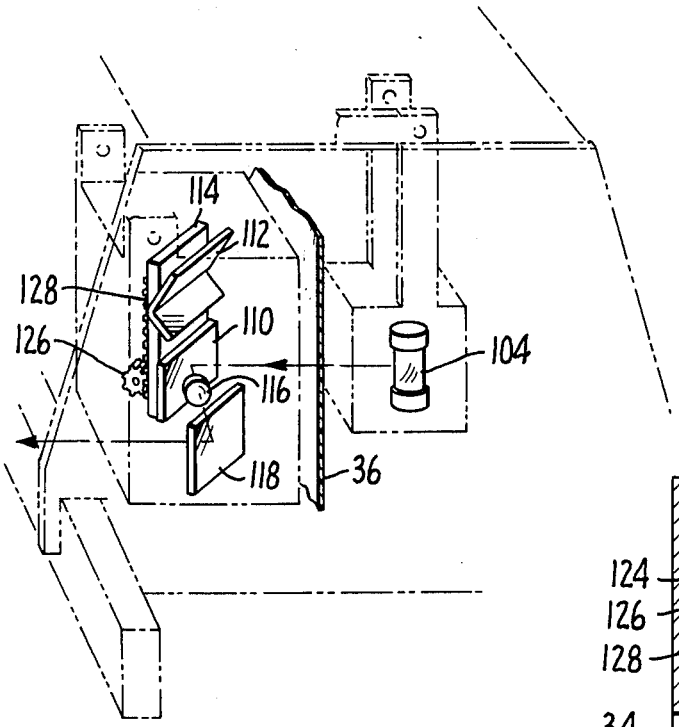
FIG. 16 is a perspective, diagrammatic view of the mechanism for indexing the image reversing mechanism depicted in FIG. 15.
Figure 19:
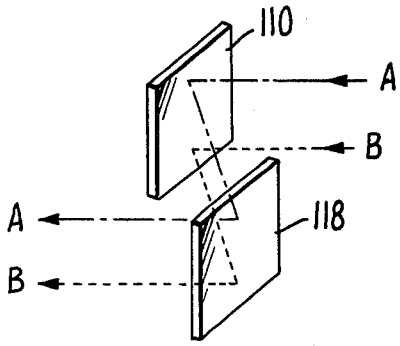
FIG. 19 and FIG. 20 are diagrammatic illustrations for use in explaining the operation of the image inverting mechanism depicted in FIGS. 15–17.
Figure 20:
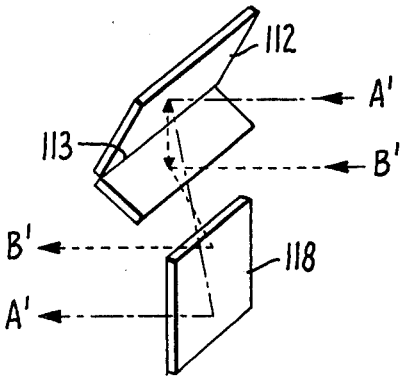
Figure 18:
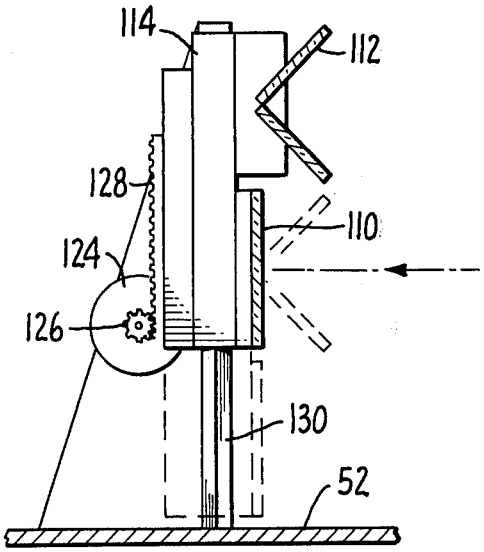
FIG. 18 is a vertical, sectional view taken generally along the lines 18—18 in FIG. 17.

This would pose no problem to the marker projector system of the invention if it were projecting directly onto the layer of fabric after it was spread onto the table. However, the projected image is always on the same side of the fabric as it drops from the roll 10 into the vertical fall 18 regardless of whether it is ultimately laid face-up or face-down. This makes it necessary to invert the projected image on alternate runs in order to locate the fabric flaws with respect to the pattern. The inversion of the image, however, is not a complete inversion as would take place in a mirror, but instead, is an inversion about a horizontal axis. Referring to FIGS. 19 and 20, it can be seen that the reflection of the points A, B from the mirror 110 to the mirror 118 and ultimately to project onto the vertical drop of cloth 18 results in no net inversion of the locations of the points. When the mirror 112 is used however, the points A', B' are inverted vertically upon the ultimate reflection by the mirror 118. The vertex 113 of the two halves of the mirror 112, which are perpendicular with respect to each other, must be parallel to the plane of the mirror 110 in order for this to take place. Moreover the vertex 113 must lie in a horizontal plane. It will be noted that the lens 116 has been omitted from the FIGS. 19 and 20 for simplicity of illustration. In operation, after the spreader 12 has completed one run along the spreading table 16 during which the mirror 110 was in a position to receive the projected image, as shown in FIG. 16, the rack 114 is lowered until the mirror 112 is in the position indicated in dashed line fashion in FIG. 18. The rack 114 is lowered by means of a gear motor 124 whose output pinion gear 126 meshes in a vertical rack gear 128 attached to the rack frame 114. The rack 114 slides vertically on a support 130.

Referring now more particularly to FIGS. 4, 5, 6 and 7, the means by which the carriage 20 is moved back and forth across the rails 24 and 26 will be explained. A motor 132 is mounted on the first carriage 22 at one side of the carriage. A gear motor drives a cable or sprocket chain 134 whose opposite ends are attached to the second carriage housing 28. The cable or chain 134 passes around a pair of pulleys 138 mounted at the same side of the first carriage as the motor 132 is mounted on. The direction of the cable or chain 134 is reversed at the opposite side of the carriage by means of a pulley 136. When the motor 132 is activated in one direction the carriage 20 is driven correspondingly in the same direction across the rails 24 and 26. When the motor 132 is reversed, the direction of the carriage travel is also reversed.

Referring now more particularly to FIG. 1, a photo-optical sensor 140 is mounted on the spreader 12 just above the point where the unrolling fabric begins the vertical fall 18. The sensor 140 is mounted to scan the edge or selvage of the fabric as it unrolls from the bolt 10. Where a flaw, such as flaw 142 appears in the fabric, a piece of reflective tape 144 is placed along the selvage. The detection of the flaw 142 is done by automated apparatus of the type previously described in this application. As will be explained in greater detail hereinafter, when the piece of reflective tape 144 is detected an audible signal will sound to the operator indicating that the spreader 12 is stopping and the carriage 20 activated to scan the fabric. In order to sense marks placed along the table, such as by means of reflective tape or painted stripes, a photo-optic sensor 146 is mounted on one end of the first carriage 22 and directly over the surface of the spreading table 16 at its edge. The sensor 146, like the sensor 140, is of the type which has its own light source and photo-optic cell. The detector operates by means of the light being reflected from some means placed opposite the sensor, such as a reflective tape. An encoder 148 is also mounted in the same end of the carriage 22 as is the sensor 146. The encoder includes a wheel 150 which rides along the spreading table 16 and which produces the series of periodic output pulses in proportion to the number of rotations of the wheel 150. As will be explained in greater detail hereinafter, the outputs from the sensor 146 and the encoder 148 are fed to a micro-processor which utilizes the input to index the film 36.

Referring now more particularly to FIGS. 21–22, the electronic control of the marker projector system of the invention will be described in greater detail. The purpose of electronic control which is about to be described is to reverse the position of the amici prism on alternate runs, to index the film at selected points when the operator requires the marker projector system to scan across the fabric to project the pattern over a flaw and to calibrate the position of the film with respect to the fabric on the table so that the projected pattern will correspond to the pattern which is ultimately laid onto the stack of spread fabric layers.

Figure 22A:
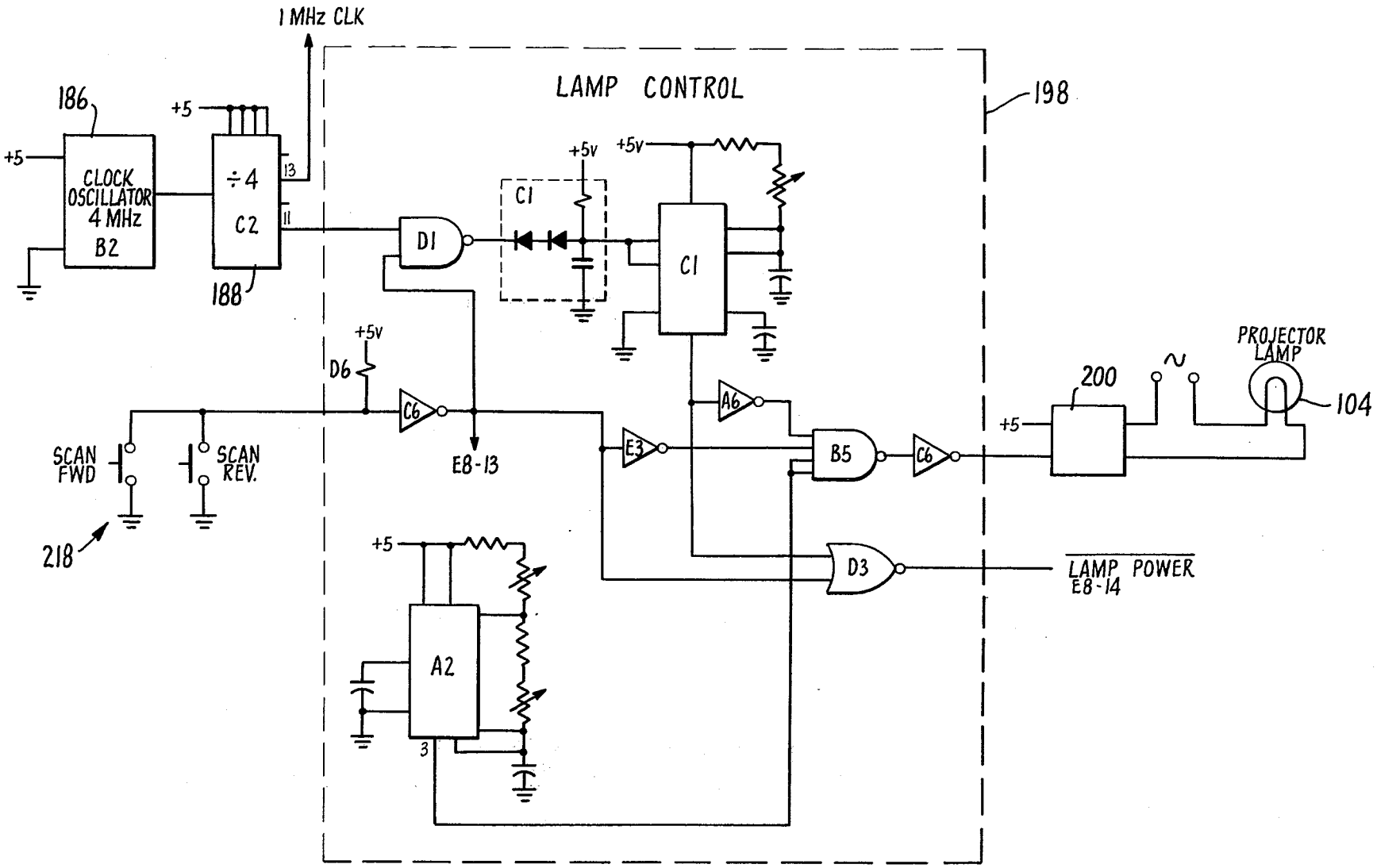
FIGS. 22A–22K, inclusive, are detailed schematic diagrams of portions of the block diagram depicted in FIG. 21.
Figure 22B:
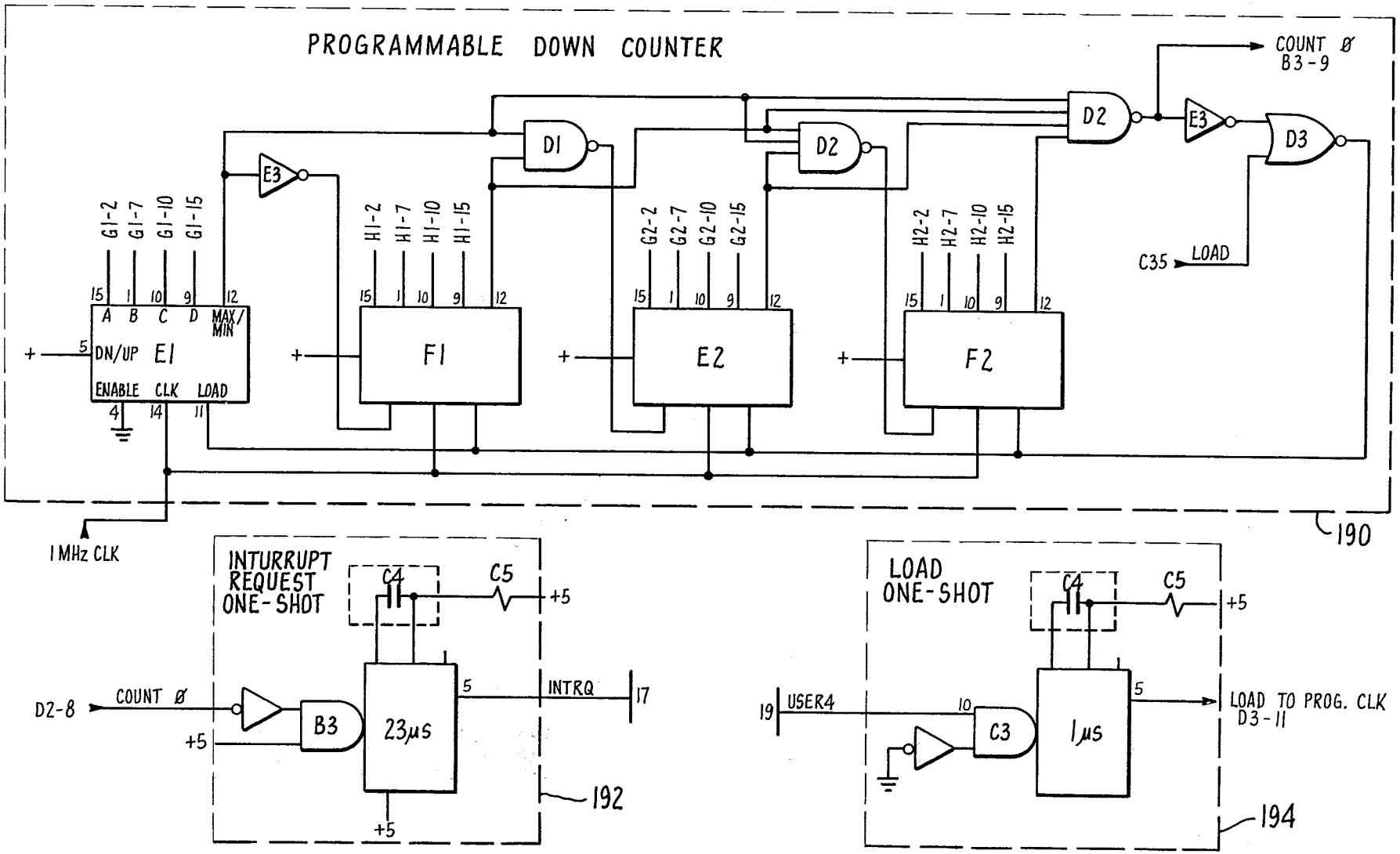
Figure 22C:
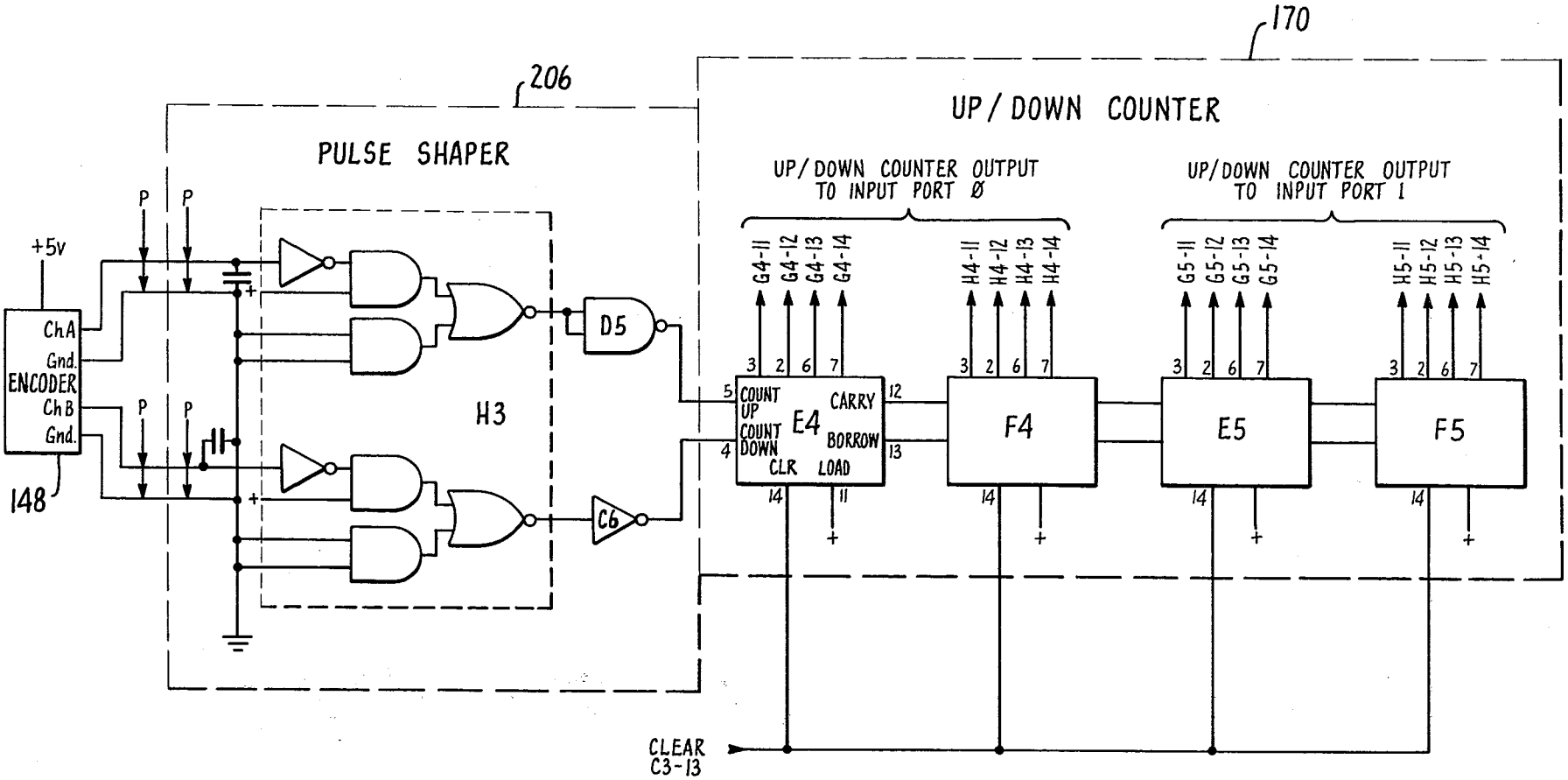
Figure 22D:
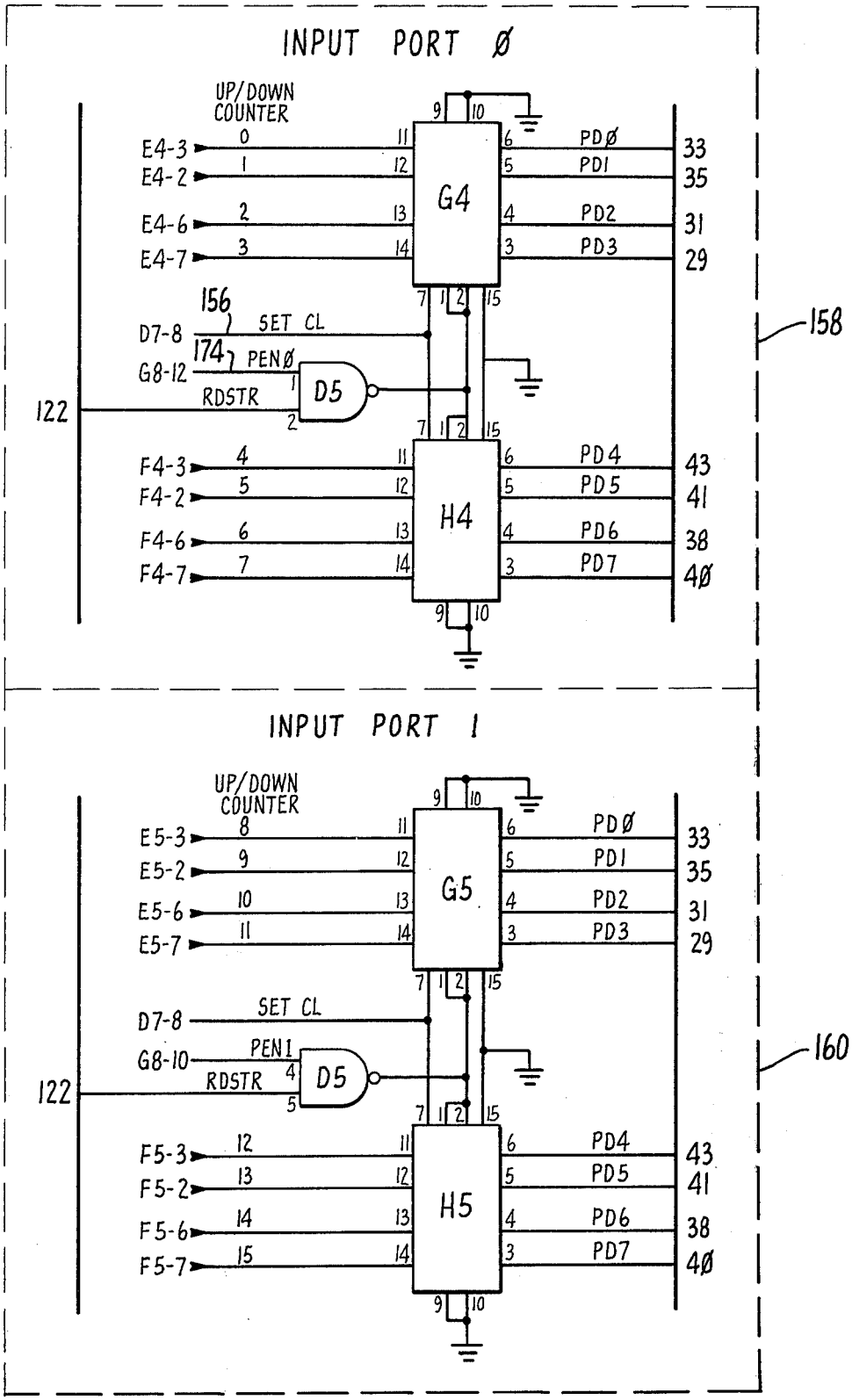
Figure 22E:
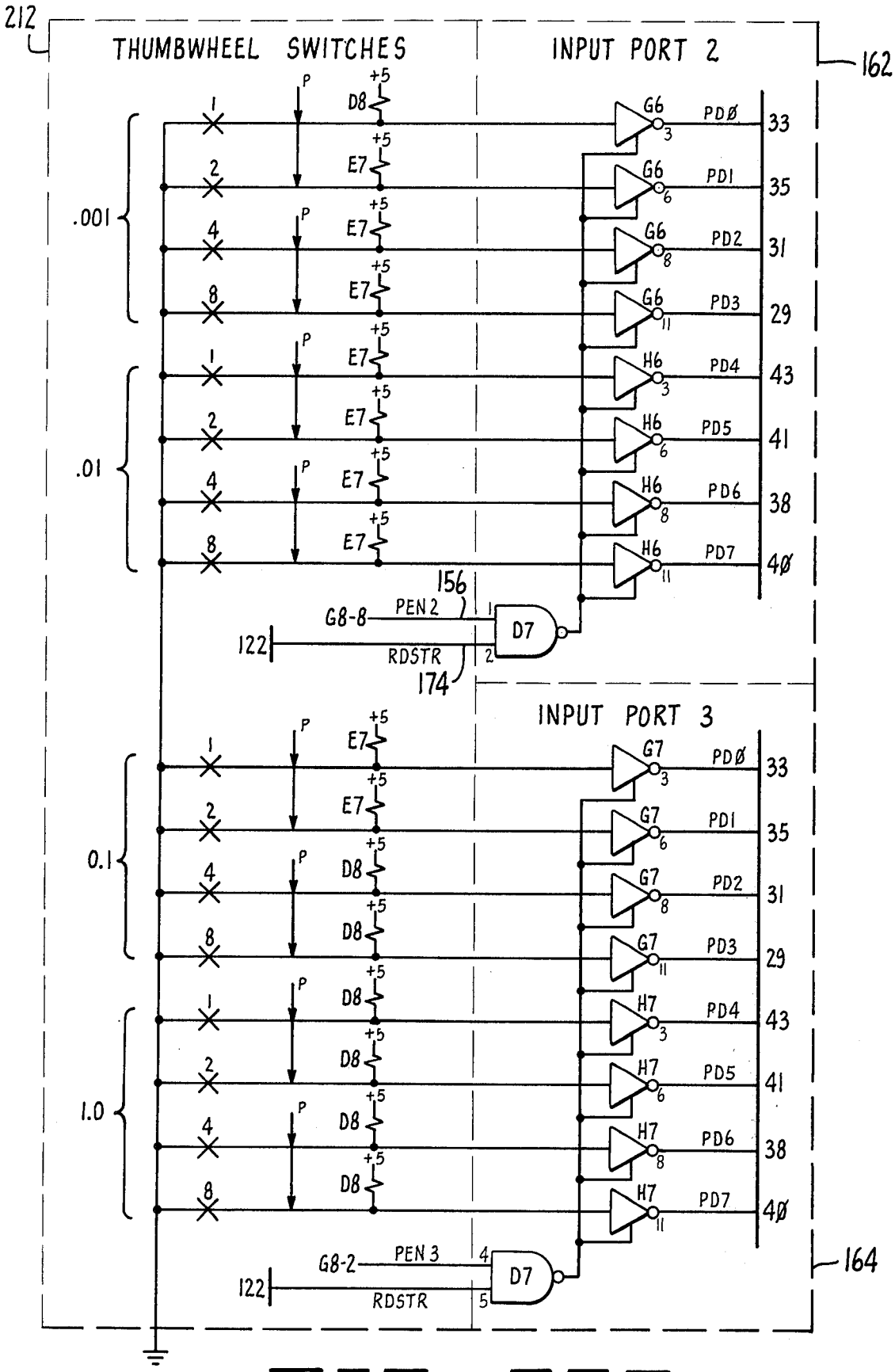
Figure 22F:
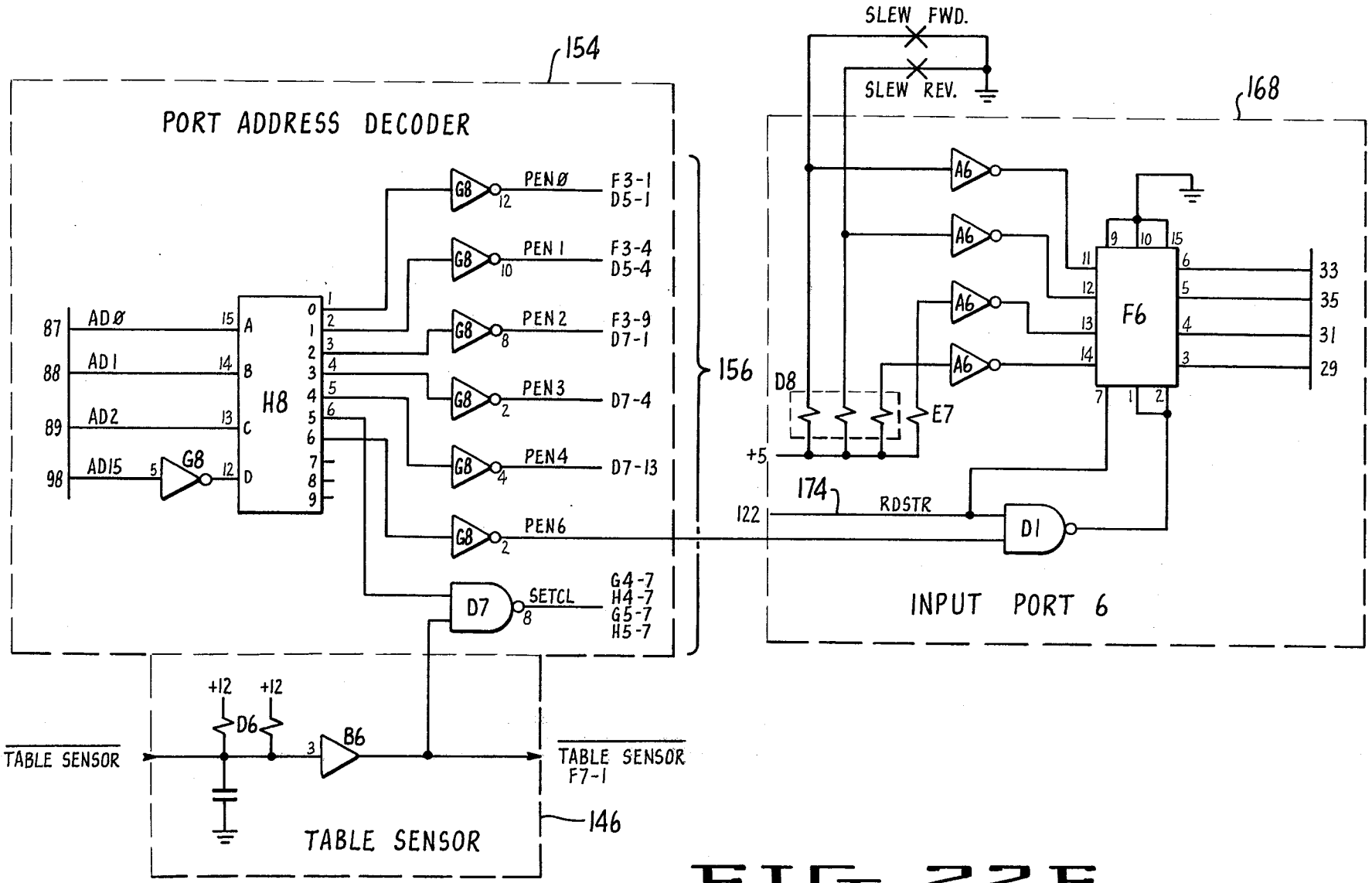
Figure 22G:
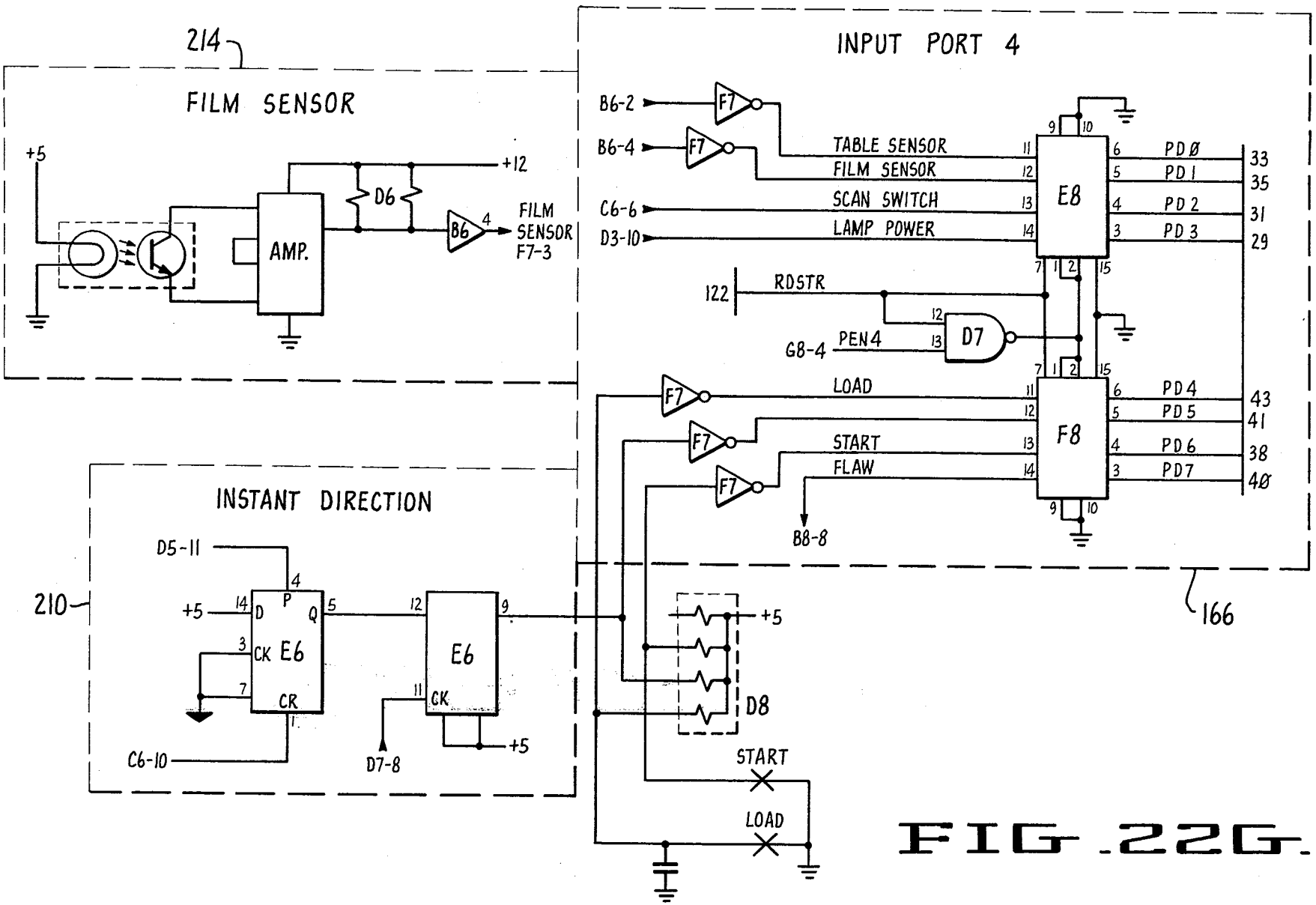
Figure 22H:
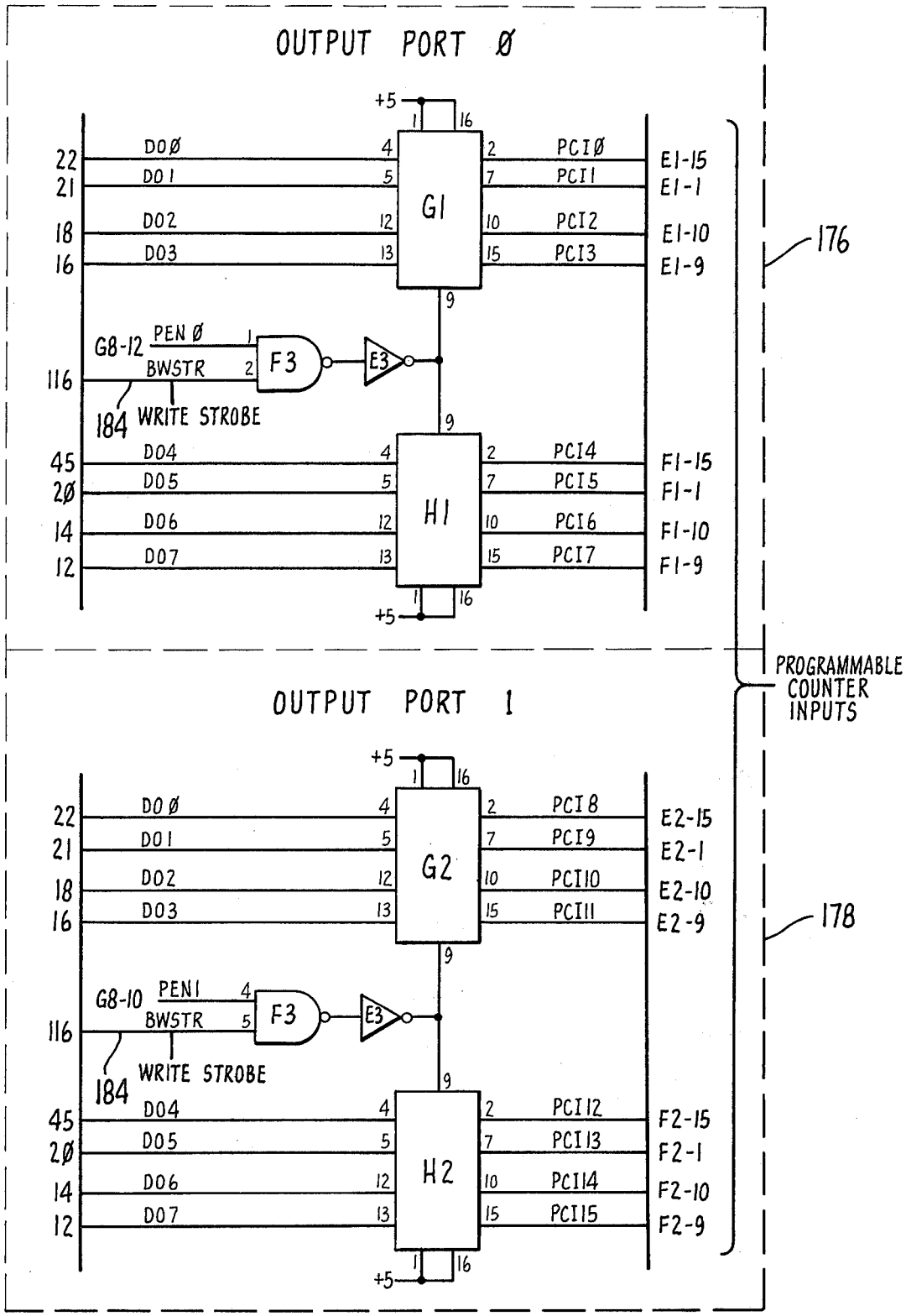

The basic control element is a micro-processor 150. The micro-processor is a general purpose, 8-bit, byte-oriented, parallel processor with a programmed read only memory. It has an 8-bit Peripheral Data Bus, 8-bit Data Out Bus, and 16 bit Address Bus. A suitable type of micro-processor would be a National Semiconductor Model IMP-8C. The port address decoder 154 is supplied with an output 152 from the micro-processor. The port address decoder uses a type 7442, 4-line-to-10-line binary to decimal decode address lines AD$\phi$-AD2 and AD15 inverted as a control line. These decoded signals are inverted by 7404's to form Port Enable signals PEN$\phi$-PEN4 and PEN6. Line 5, as shown on FIG. 22F is used to generate the set counter latch (SETCL) signal which loads a number in an up-down counter 170 into an input port $\phi$ (158) and 1 (160) latches. It should be noted that the various components of this electronic control system have been assigned reference numerals for the purpose of this patent application, however, in the schematic drawings of FIGS. 22A–22K, they are also provided with alpha numeric legends. For better clarity of illustration, the alpha numeric legends have been retained.

Input ports $\phi$ (158) and 1 (160) each consist of two 8T10 Quad Tri-State latches. Data is latched by the SETCL signal generated by the address decoder 154 or from the table sensor 146 when a table mark is sensed. Data is placed on the peripheral bus 172 of the micro-processor 150 when the proper port enable (PEN) signal 174 is received along with a RDSTR (Read Strobe) from the micro-processor 150. Input port $\phi$ (158) contains the lower 8-bits from the 16-bit up-down counter 170 and port 1 (160) contains the upper 8-bits from the counter 170. (See FIG. 22D).

The pair of input ports 2 (162) and 3 (164) each consist of two 8T10 Quad-Tri-State Bus Drivers. Data is continuously available from a set of ply height thumbwheel switches 212 and is placed on the peripheral data bus 172 of the micro-processor 150 when the proper port enable signal is received along with a read strobe 174. The port 2 (162) contains the lower two digits from the thumbwheel switches 212 and the port 3 (164) contains the upper two digits from the thumbwheel switches 212. (See FIG. 22E).

A pair of input ports 4 (166) and 6 (168) each consist of an 8T10 quad tri-state latch. The latches are loaded by the read strobe signal 174 from the micro-processor 150 and are enabled by the proper port enable signal from the address decoder 154 along with the read strobe signal 174. The bulk of the physical controls carried out by the micro-processor are done through three output ports, numbers $\phi$ (176), 1 (178) and 2 (180). These ports each consist of type 74175 quad latches. Data on a data out bus 182 of the micro-processor 150 is latched when the proper port enable signal from the decoder 154 occurs along with a write strobe signal 184 (BWSTR). (See FIGS. 22H and 22I).

Clock pulse signals for the system are generated by a 4 MHZ oscillator 186. Such as oscillator may be, for example, a Motorola type K1100A. The output from the clock oscillator 186 is fed into a divide by 4 logic unit 188. The divide by 4 unit 188 consists of a type 74161 binary counter. The counter not only divides the clock output by 4, but also divides it by 16. The divided by 4 output is furnished as a 1 MHZ clock signal to a programmable down counter 190. The divided by 16 output furnishes a 250 KHZ clock signal to a lamp control circuit 198. (See FIG. 22A).

The programmable down counter 190 consists of four type 74191 binary up-down counters, connected to count down, and decoding logic. The counter 190 is programmed from the output ports $\phi$ (176) and 1 (178) to produce clock pulses at intervals from 1 microsecond to 65.5 milliseconds in 1 microsecond increments. The counter output drives an interrupt request one-shot multivibrator 192. (See FIG. 22B).

The interrupt request one shot multivibrator 192 consists of one-half of a type 74123 dual, one-shot multivibrator which is timed to produce a 23 microsecond width pulse to the micro-processor 150 on an interrupt request line when it receives a count equals $\phi$ (count $\phi$) pulse from the down counter 190. (See FIG. 22B).

The programmable counter receives an output from a load one-shot multivibrator 194. The load one-shot multivibrator consists of one-half of a type 74123 dual, one-shot multivibrator timed to produce a 1 microsecond width pulse to the load input of the down counter when the one-shot multivibrator 194 receives a pulse from the micro-processor 150 on USER 4 line.

A lamp power switch 196 consists of an alternate action push-button switch that activates a relay through a lamp control circuit 198 to supply 120 volts alternating current to the lamp blower 106 and to a solid state relay 200 for control of the projector lamp 104. The lamp control 198 consists of two type 555 timers and associated logic to control a solid state relay 200 in series with the projection lamp 104 and to furnish a lamp power on signal to the micro-processor 150 through the input port 4 (166). Timer A2 shown in FIG. 22A provides an idle state filament current to operate the lamp 104 in a dimmed state for periods when the image is not being projected. The timing is adjusted such that the solid state relay 200 is turned on for approximately one-half cycle every three cycles of the 60 HZ alternating current line. Timer C1 shown in FIG. 22A provides for full brightness viewing. When the scan switch 202 is activated, timer C1 continuously triggers at a 250 KHZ rate from the divide by 16 output of unit 188. After the scan switch 202 is released, the timer keeps the lamp at full brightness for an adjustable period of 10 to 60 seconds. Control of the solid state relay 200 then reverts back to the A2 timer for dimmed operation. The LAMP POWER signal is furnished to the micro-processor 150 through the input port 4 (166) when the lamp 104 is at full brightness.

The solid state relay 200 is controlled by the lamp control 198 and is in series with the lamp 104 with the 60 cycle alternating power supply. The solid state relay 200 could be for example a 10 amp solid state relay made by Monsanto Model MSR100B or ECC D1210. The projection lamp 104 can be a Sylvania Model EGX, 500 watt projection lamp. The scan switch 202 is a double-pole-double-throw momentary contact switch. It provides closure to the lamp control circuit 198 and forward and reverse closures to the scan direction control circuit 204. (See FIG. 22A).

The scan direction control circuit 204 uses a conventional contact relay (DPDT) for reversing the scan drive motor 132 which moves the second carriage back and forth across the rails 24 and 26. The control 204 also uses a solid state relay to turn on power to the motor 132 and passive components to form a delay circuit. When the scan reverse switch 202 is closed, the reversing relay is immediately operated. After a delay to allow relay operation, the solid state relay is operated, turning on power to the scan drive motor 132. When the scan reverse switch 202 is released, the solid state relay turns off on the next zero crossing of the alternating current and the reversing relay turns off after a delay. When the scan forward switch 202 is operated, the solid state relay turns on at the first zero crossing the alternating current supply and the reversing relay remains in its normal position. This circuit prevents large transients from being introduced onto the alternating current line which would occur if the relay contacts were switched with the power on. (See FIG. 22K).

The scan drive motor 132 which shuttles the second carriage 28 back and forth on the rails 24 and 26 may be a type Dayton Gearmotor Model 2Z803, rated at 1/15 H.P. with a 52:1 ratio.

The encoder 148 is a Renco Series No. 2500, incremental optical encoder with 400 pulse per revolution direction sensing when fitted with a 12 inch circumference wheel 149. The pulse shaper 206 consists of a type 8T14 Triple Reveiver with Hysteresis and inverters to convert the pulses from the encoder 148 to the proper polarity. As previously mentioned, the wheel of the encoder rides on the tracks of the spreading table 16 and provides an indication to the micro-processor 150 of the position of the spreader 12 along the table. The up-down counter 170 consists of 4 type 74193 up-down counters used to count pulses from the encoder 148. Movement of the spreader 12 in the positive direction along the table 16 increments the counter, by means of the encoder output, and movement in the opposite or negative direction decrements the counter 170. Thus, the count indicates the position of the spreader from a reference point up to 163 feet in 0.03 inch increments. The output of the counter 170 is transferred to the micro-processor 150 through input ports $\phi$ (158) and 1 (160). (See FIG. 22C).

A clear one-shot multivibrator 208, depicted in the right-hand portion of FIG. 21, consists of one-half of a type 74123 dual one-shot multivibrator timed to provide a one microsecond width clear pulse to the up-down counter 170 at initialization in response to a low to high transition signal of bit 2 of output port 2 (180). (See FIG. 22I).

The instantaneous direction circuit 210, consists of a type 7474 dual D-type flip-flop which monitors the count up and count down inputs to the up-down counter 170 to determine instantaneous direction of travel of the spreader 12. (See FIG. 22G).

The ply height thumbwheel switches 212 are set by the operator to give the height of 100 layers of the particular fabric being spread. It is necessary to take this ply height into account in order to compensate for the differing lengths of the vertical fall 18 to the top most layer of the spread stack. Once the height limit is programmed in by means of the thumbwheel switches, the micro-processor 150 will take this height into account, will count the number of spread layers and will provide an appropriate off-set to the indexing system for the film 36 to correctly position the pattern when it is projected onto the fabric. The thumbwheel switches 212 consist of 4 digit binary coded decimal thumbwheel switches used to tell the micro-processor 150, through the input ports 2 (162) and 3 (164) the height of 100 layers of the fabric. (See FIG. 22E).

The table sensor 146 is a reflective photodetector and, as mentioned above, it detects marks on the tracks of the table 16. The film sensor 214 is a photodetector which, as mentioned above, detects marks on the film.

The load switch 216 is an alternate action double-pole double-throw push button switch which is used while loading film. It provides a signal to the micro-processor 150, through the input port 4 (166) and turns off the tension motors 220 for the film 36. The slew switch 218 is a double-pole double-throw momentary contact rocker switch which is used when loading and unloading the film. It provides forward and reverse signals to the micro-processor 150 through the input port 6 (168) and energizes the tension motors 68 and 70. The tension motor relay 220 is a single-pole single-throw relay which is used to supply alternating current power to the tension motors 68 and 70. The tension motors 68 and 70 are 1/40 H.P. shaded pole motors operating stalled in opposite directions on the film rollers 58 and 66. 100 ohm adjustable resistors in series with the motors allow the tension to be adjusted. (See FIG. 22K).

The start switch 222 is a momentary contact pushbutton switch which is used to signal the micro-processor 150 through the input port 4 (166) during the initialization of the system. The ready time-out and lamp 224 consists of one-half of a type 74123 dual retriggerable one-shot multivibrator timed for 100 milliseconds and 2 type 7406 buffer gates used as lamp drivers. When the micro-processor program is operating properly, the one-shot multivibrator is retriggered before the end of its timing cycle by a signal on the USER1 line from the micro-processor 150 and the ready lamp remains turned on.

The stepper motor direction control circuit 226 consists of a type 74123 dual one-shot multivibrator and two type 7406 buffer gates. Signals on the USER2 and USER3 lines from the micro-processor 150 trigger one or the other of the two one-shot multivibrators which provide 113 millisecond pulses to the stepper motor electronics. The stepper motor 72 is a SLO-SYN stepping motor M-series with type TBM control electronics. (See FIG. 22K).

The level shifter 228 shifts a −40 volt level signal from the spreader 12 to the TTL voltage level of the electronics of the control system. The flaw latch 230 consists of two R-S latches formed from type 7400 gates, type 7402 input gating and a type 75452 driver to drive the audible indicator 232 and the visual indicators. A signal from the level shifter 228 sets both latches. The upper latch signals the micro-processor 150 through the input port 4 (166) that a flaw has been found. It is reset when the stepper motor 72 starts to advance the film 36. The lower latch turns on the audible and visual indicators. It is reset when the scan switch 202 is activated.

The calibration lamp 234 is energized by a signal from bit 1 of output port 2 (180) which is buffered by two type 7406 gates to turn on the calibration lamp indicating that the system is in the initialization phase.

Figure 22I:
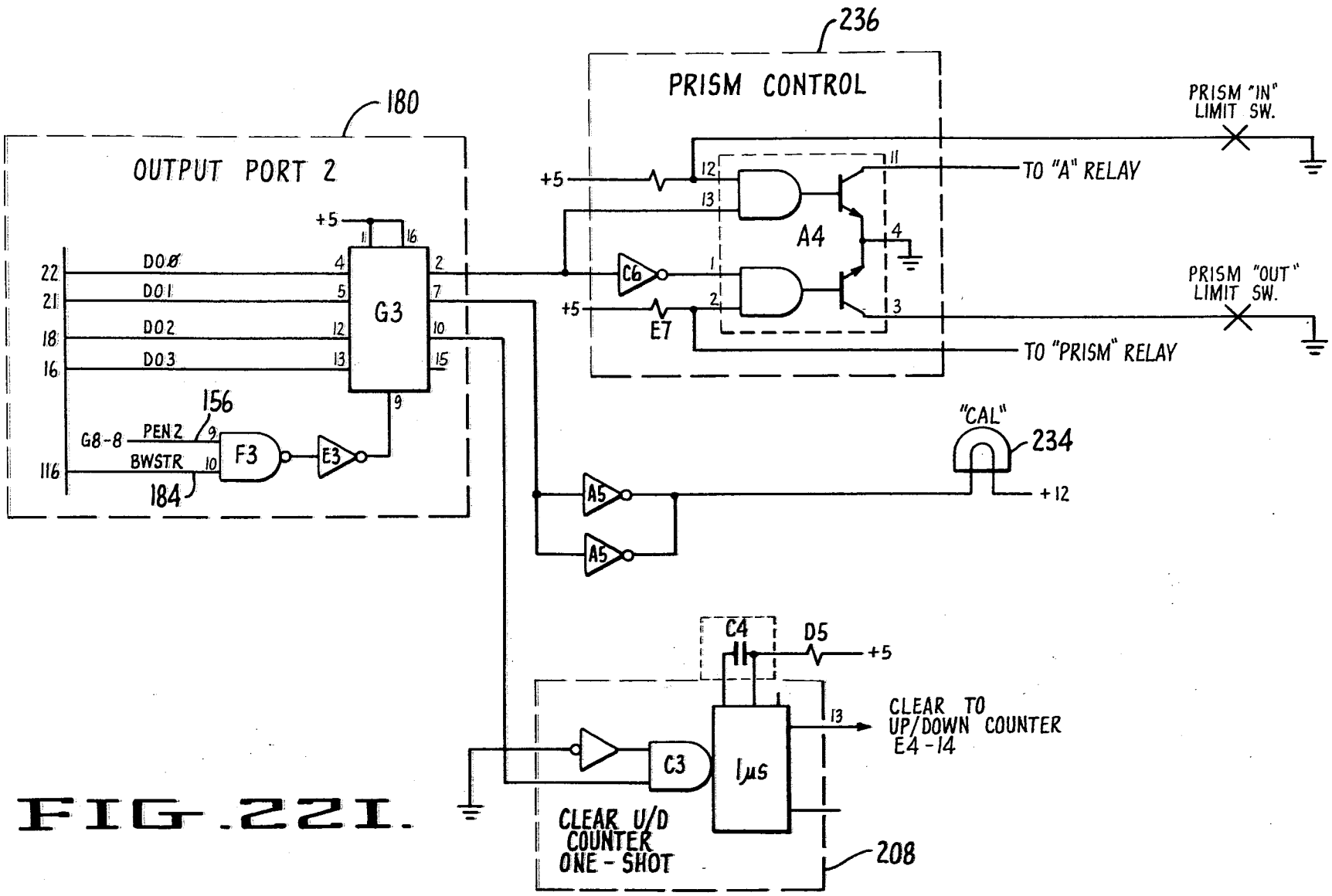
Figure 22J:
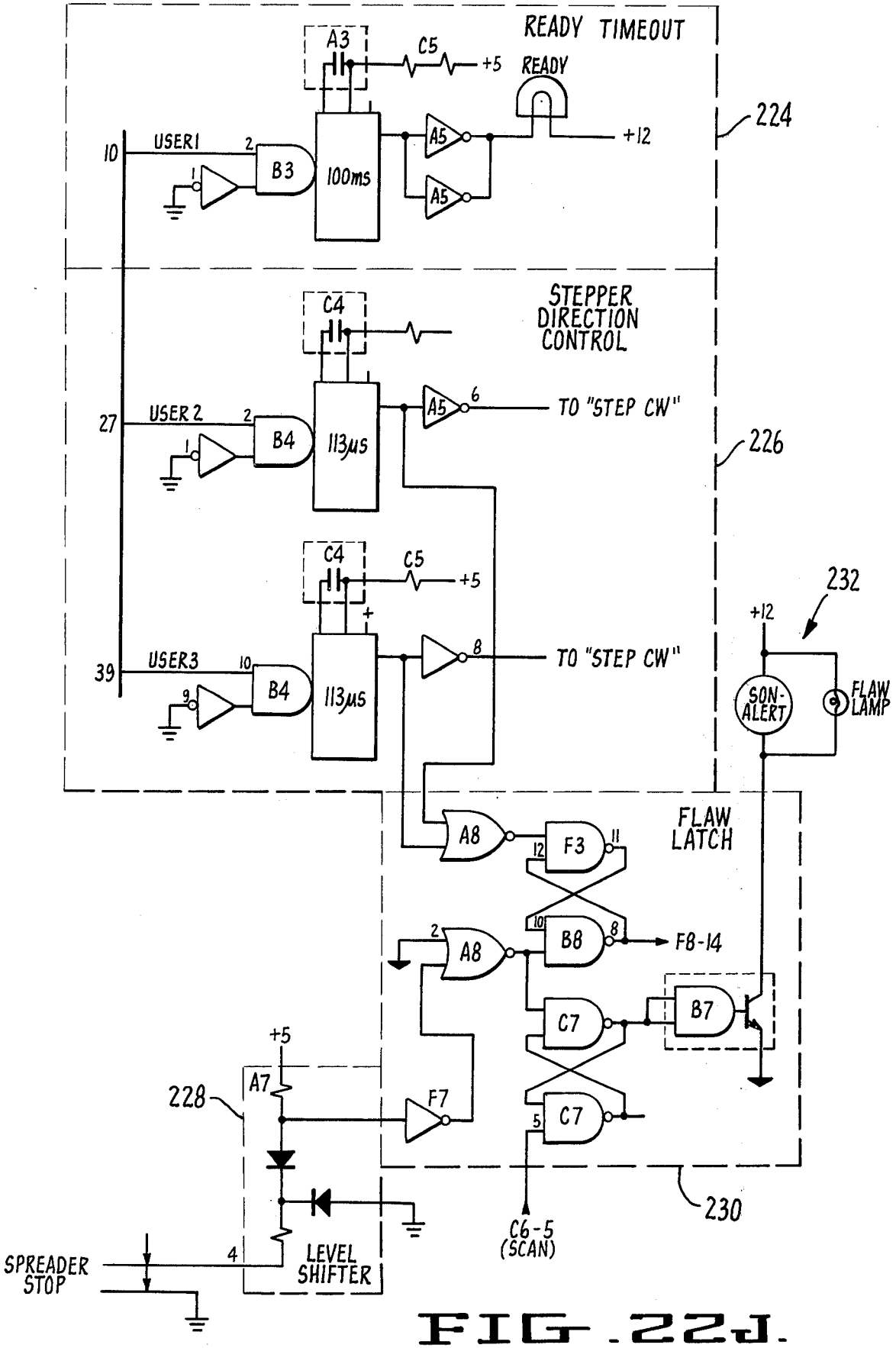

The prism control circuit 236 is depicted in FIG. 22I. Bit $\phi$ of output port 2 (180) drives one-half of a type 75452 driver directly and is inverted to drive the other half. Depending on the polarity of this signal, either the prism relay or the prism relay and the "A" (reversing) relay 238 is activated. The delay circuit is the same as in the scan circuit. Limit switches disable the drivers when the prism is in place. The prism exchange motor 124 is a Dayton 1/100 H.P. 20 RPM Gearmotor.

Figure 22K:
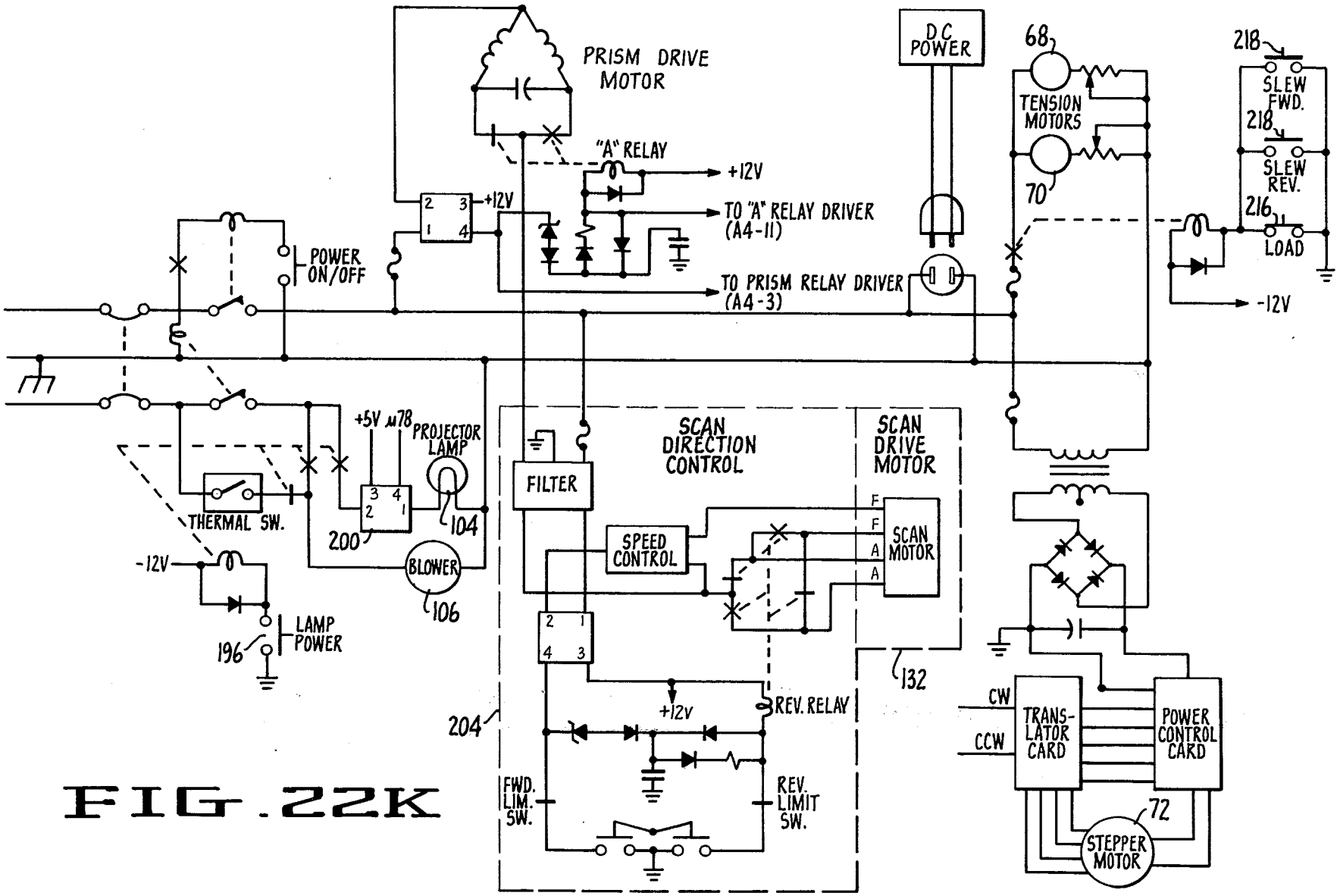

The power supply 240 is shown in greater detail in FIG. 22K. Input is 208 volts alternating current with input power to the D.C. supplies and motors being taken from the line to neutral. The power is turned on by activating a relay manually from a switch. A safety switch prevents power from coming on after a power failure until it has been manually reset. The D.C. supplies are Standard Power open frame modular supplies. Power for the stepping motor 72 is furnished through a transformer, full-wave bridge and capacitor filter.

The operation of the control circuit is as follows. As mentioned above, the table 16 has marks on its surface that represent the marker positions. The markers are the segments of the pattern and correspond to segments of the film 36 which are reduced by one-fifth scale from actual size. These marks can be sensed by the table sensor 146. The reference medium or film 36 also has marks on it which the film sensor 214 detects. During an initialization run, the micro-processor 150 stores table sensor inputs, that is signals representing the marks on the table, with input signals from the encoder 148, that is pulses generated from moving the spreader down the table. The micro-processor 150 then issues a command to the film motor 72 via the lines USER2 or USER3 to run. The micro-processor notes the film marks on the film through the sensor 214 and the input port 4 (166). If the number of marks coincide, the program of the micro-processor outputs a "ready" signal via line USER1 to the control panel lamp 224. Any movement of the spreader 12 is detected by the encoder 148 and appropriate signals are given to the up-down counter 170. The micro-processor monitors this interface at very small time intervals. By knowing the number of marks, the number of marks detected and the encoder count, the major direction of the travel is known through the instant direction sensor 210. This information is used to determine whether the amici prism is to be used and the amount of off-set, as initially programmed by the thumbwheel switches 212, required by the film motor 72 to display the image correctly. The film transport motor 72 is brought into action only when requested by actuating the scan drive switch 202 which is coupled through input port 4 (166) to the micro-processor 150. At that time, the micro-processor 150 makes all of its adjustments. Errors can be corrected by the micro-processor 150 by comparing the initialization run with where the marks appear to be now.

The detail functioning of the microprocessor 150 will now be described with reference to FIGS. 23A–23M which together comprise a software block diagram or programming flow chart for the microprocessor.

The microprocessor sub-system consists of the processor elements themselves plus 256 bytes of RAM which are used as working storage, plus 7 ultra-violet PROMS, each of which has 256 bytes of memory. The PROMS are used for storage of programs and data constants.

Inputs/Outputs:

This section will give a general description of the microprocessor interface.

Input Port 0 (158) — Bit 0 through bit 7 of the UP/-DOWN counter 170.

Input Port 1 (160) — Bit 8 through bit 15 of the UP/-DOWN counter 170.

The counter output is binary and requires two words. The data from the counter is latched automatically by the table sensor 146 when a mark is detected. The latches may be set at other times by a Port 5 Enable, PEN 5 signal. However, the data can be read only with Port 0 Enable PEN 0 signal for the lower order bits, and Port 1 Enable PEN 1 signal for the higher order bits.

Input Port 2 (162) — Ply Height — Thumbwheel switch 212 — Bits 0 through 3 contain BCD (1,2,4,8) for the thousandths (0.001) position. Bits 4 through 7 contain BCD for the hundredths (0.01) position.

Input Port 3 (164) — Ply Height — Thumbwheel switch 212 — Bits 0 through 3 contain BCD for the tenths (0.1) position. Bits 4 through 7 contain BCE for the units (1.0) position. (Inches per 100 ply.)

Input Port 4 (166) — Contains the signal outputs that must be monitored or checked often:

Bit 0 — Table Sensor 146 — "1" indicates a mark on the table.

Bit 1 — Film Sensor 214 — "1" indicates a mark on the film.

Bit 2 — Scan Switch 198 — "1" indicates an operator request for service.

Bit 3 — Lamp Power 198 — "1" indicates projector lamp is OFF.

Bit 4 — Load Film Switch 216 — "1" indicates operator request for service.

Bit 5 — Spreader Instantaneous Direction (210) — "1" indicates −X.

Bit 6 — Start Switch 222 — "1" indicates operator request for service.

Bit 7 — Flaw Detector 230 —"1" indicates spreader stop switch has been operated or flaw mark detector has detected mark.

Input Port 6 (168) — Bit 0 — Plus X film slew 218 request, where "X" is a given direction of spreader movement. Bit 1 — Minus X film slew 218 request. Bits 2 through 7 — Unused.

Output Port 0 (176) — Bit 0 through bit 7 to the programmable down counter 190.

Output Port 1 (178) — Bit 8 through bit 15 to the programmable down counter 190.

The programmable down counter or "clock" 190 is programmed by loading the binary of the interval required in microseconds with the eight lower order bits latched in Output Port 0 (176) and the eight higher order bits latched in Output Port 1 (178). The interval may be started immediately with a PFLG4 or may be allowed to start automatically at the end of the interval previously programmed. At the end of the interval, an Interrupt Request (INTRQ) will be generated and the clock will restart. The clock will provide Interrupt Requests at the same interval until it is re-programmed.

Output Port 2 (180) — Contains only four lower order bits.

Bit 0 — "1" = Prism In "0" — Prism Out

Bit 1 — "1" = Cal Lamp ON "0" — Cal Lamp OFF

Bit 2 — "1" = Clear UP/DOWN Counter 170

"0" = Must hame 0 to 1 transition to provide CLEAR

Bit 3 — Not Used.

USER 1 — Ready lamp 224 has a 100 ms time out. PFLG1 must occur at less than 100 ms intervals or the READY lamp will go off.

USER 2 — PFLG2 — Step CW signal to film transport stepper control 226.

USER 3 — PFLG3 — Step CCW signal to film transport stepper control 226.

USER 4 — PFLG4 — Load to programmable clock 190.

General Description:

The MPS software can be divided into the sub-sections listed below:

1. Initialization Section
2. Calibration Section
3. Ready Loop
4. Tracking Logic
5. Interrupt Processing
6. Error Correction Routines
7. Double Byte Math and Miscellaneous Utility Routines.

Initialization Section: (See FIG. 23A)

The Initialization Section is entered when power is applied to the microprocessor sub-system. The MPS automatically starts executing instructions at location "7FFE" from which a jump to the Initialization Section is executed. The following functions are then performed:

1. Initialization of software flags and working storage.
2. Servicing of the slew controls on the film transport.
3. The monitoring of those conditions which are necessary to proceed into the calibration mode of operation. Those conditions are listed below:
   (a) depression of INIT (START) push button 222 (causes exit from sub-routine SLEW).
   (b) confirmation that the film transport is not in the LOAD mode.
   (c) presence of a film mark beneath the film mark sensor 214.

Calibration Section: (See FIGS. 23B–23E)

When the conditions described above are satisfied, the program will enter the Calibration Section. Entry of this section is indicated by illumination of the CAL light 234 when passing over the first table mark.

Once the CAL light 234 is turned on, the program immediately begins to monitor the spreader table mark sensor 146. Each time the sensor indicates the presence of a table mark, the program reads the spreader motion encoder up/down counter 170 and stores this value in the next successive location within a buffer reserved for that purpose within the computer's RAM. A counter is incremented each time a table mark is detected and its position thus recorded. There is also some additional logic to avoid detection of the same mark more than once.

While in the Calibration mode, the computer is also continually monitoring the INIT switch 222. The INIT switch 222 is used by the operator to signal to the computer when he has completed his CAL run with the spreader. When the program senses that the INIT (START) push button 222 has been depressed, it proceeds to advance the film transport stepper motor 72 a distance which is long enough to assure that all the marks on the film will pass under the sensor 214. The distance which is actually used is determined by taking the position of the last spreader table mark detected, converting it to an equivalent number of film transport pulses, then adding a fudge factor of about 24.5 inches. This assures that the transport will be advanced far enough to pass all the film marks beneath the film mark sensor 214. It also requires the operator to put 2 or 3 feet of a trailer on this film to assure that the film is not pulled off the end of the roller.

Once the film advance is initiated by the program, it proceeds under interrupt control (refer to the discussion on the interrupt processing software below). During this film advance, the program is continually monitoring the film mark sensor 214. The position of each detected film mark is buffered and each mark is counted in a fashion similar to the analogous operation previously completed for the spreader table marks.

Next, the program compares the number of spreader table marks detected to the number of film marks detected. These two numbers should be the same. If they are not the same, the film transport is returned to the initial position and the program returns to the Calibration Section to allow the operator to repeat the calibration procedure. If the number of marks detected on the spreader table does equal the number of marks detected on the film, then the program advances to the ready loop.

In summary, the output of the Calibration Section is a pair of tables in RAM, the first of which contains the position of each spreader table mark, the second of which contains the position of each film mark.

Ready Loop: (See FIGS. 23E–23H)

The system Ready Loop is so called because the program structure is simply a loop in which a number of conditions as described below are monitored. Within this Ready Loop, the READY lamp 224 is strobed. The READY lamp 224 is such that it will remain illuminated only if it is strobed at least once every 100 ms. Therefore, the presence of the READY light 224 assures one that the program has not only entered the Ready Loop, but is still in the Ready Loop.

All of the conditions listed below are monitored within the Ready Loop (see FIGS. 23F, 23G):

1. Depression of the film transport scan switch.
2. Depression of the spreader stop switch.
3. Movement of the spreader into either of the "end-zones".
4. Presence of a film mark beneath the film sensor (sensed for error correction purposes).
5. Presence of a spreader table mark beneath the table mark sensor (sensed for error correction purposes).

Depression of the film transport scan switch 202 or spreader stop switch by the operator is detected by the program while it is in the Ready Loop and causes the program to enter a mode in which the film transport is made to "track" the motion of the spreader. This tracking logic is described in more detail below, in reference to FIGS. 23I–23J. The program will remain in the tracking mode until the projector lamp 104 goes out (a condition also sensed by the program).

Figure 23A:
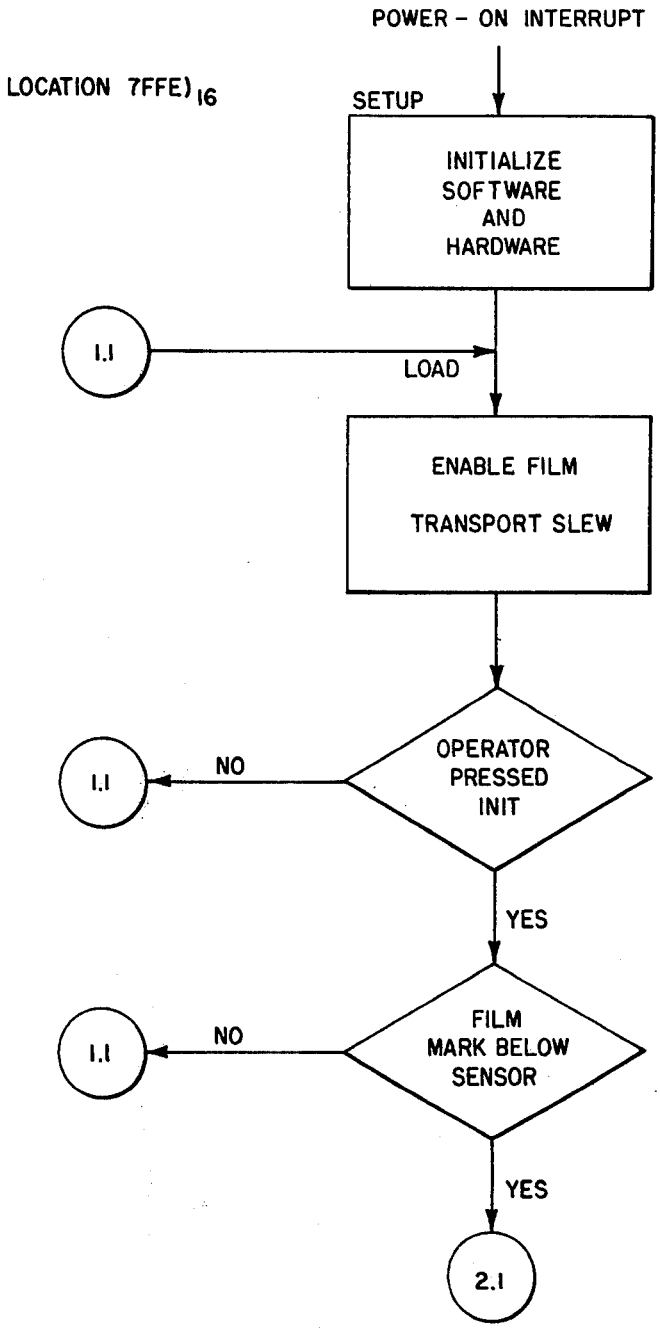
FIGS. 23A–23M are flow charts of the microprocessor program depicted in FIG. 21.
Figure 23B:
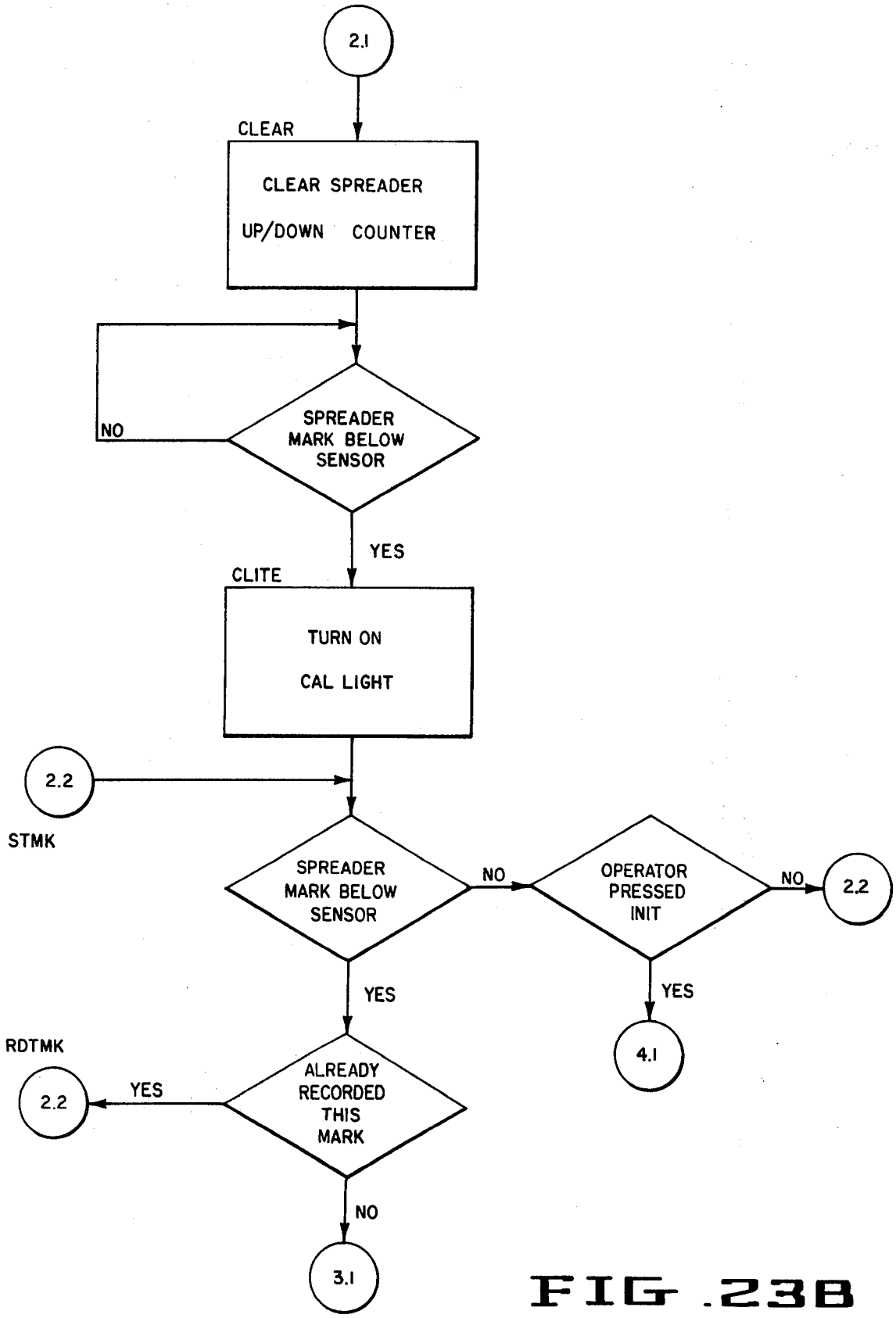
Figure 23C:
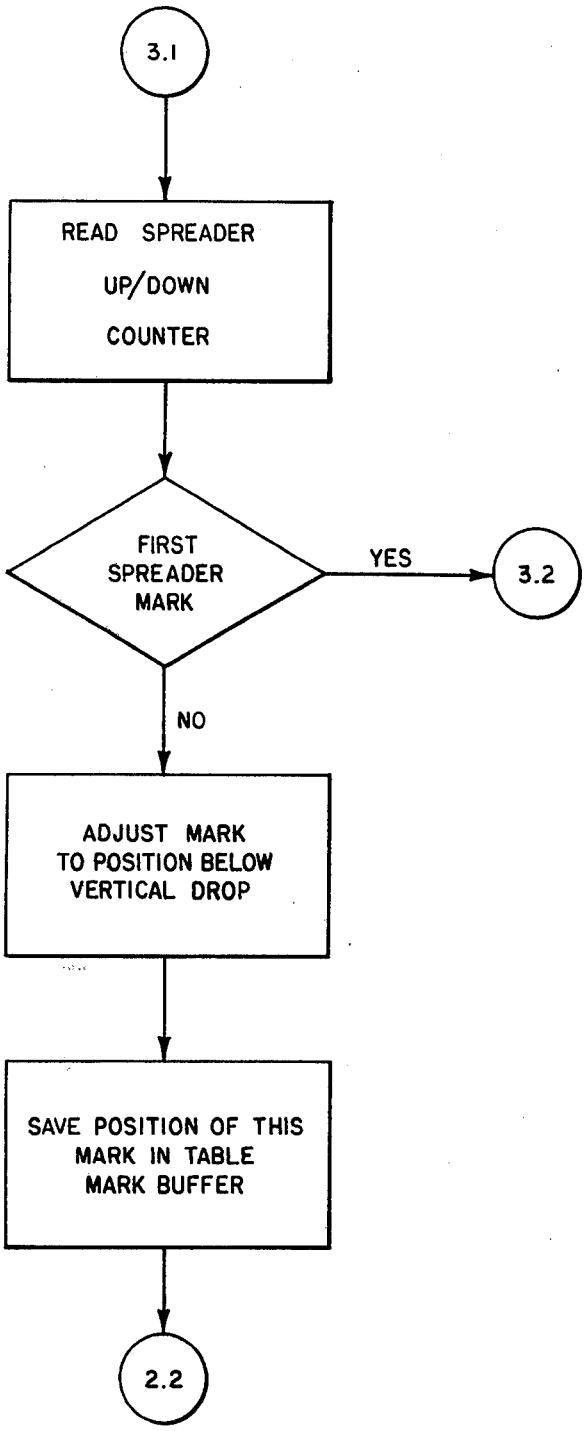
Figure 23D:
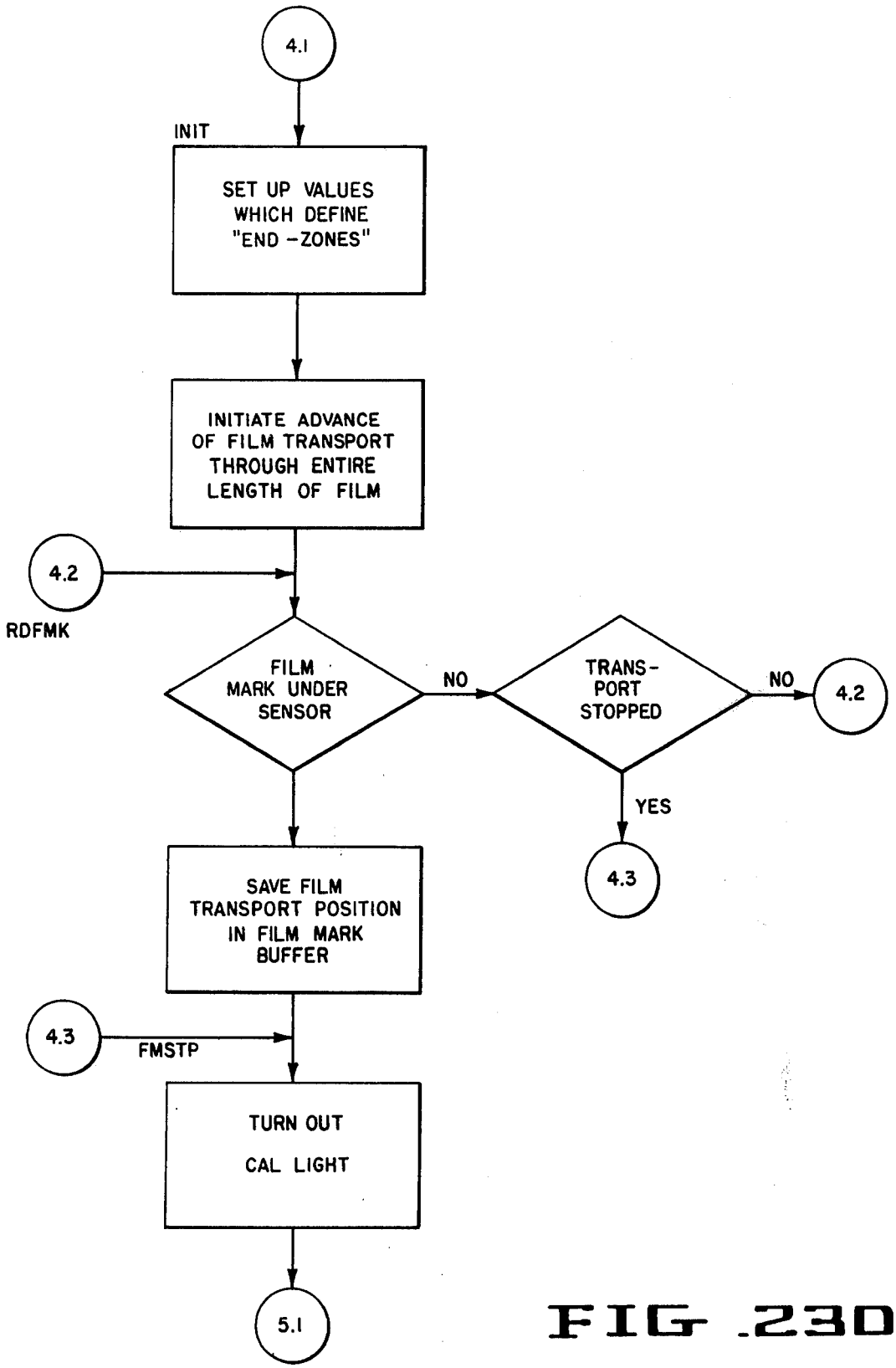
Figure 23E:
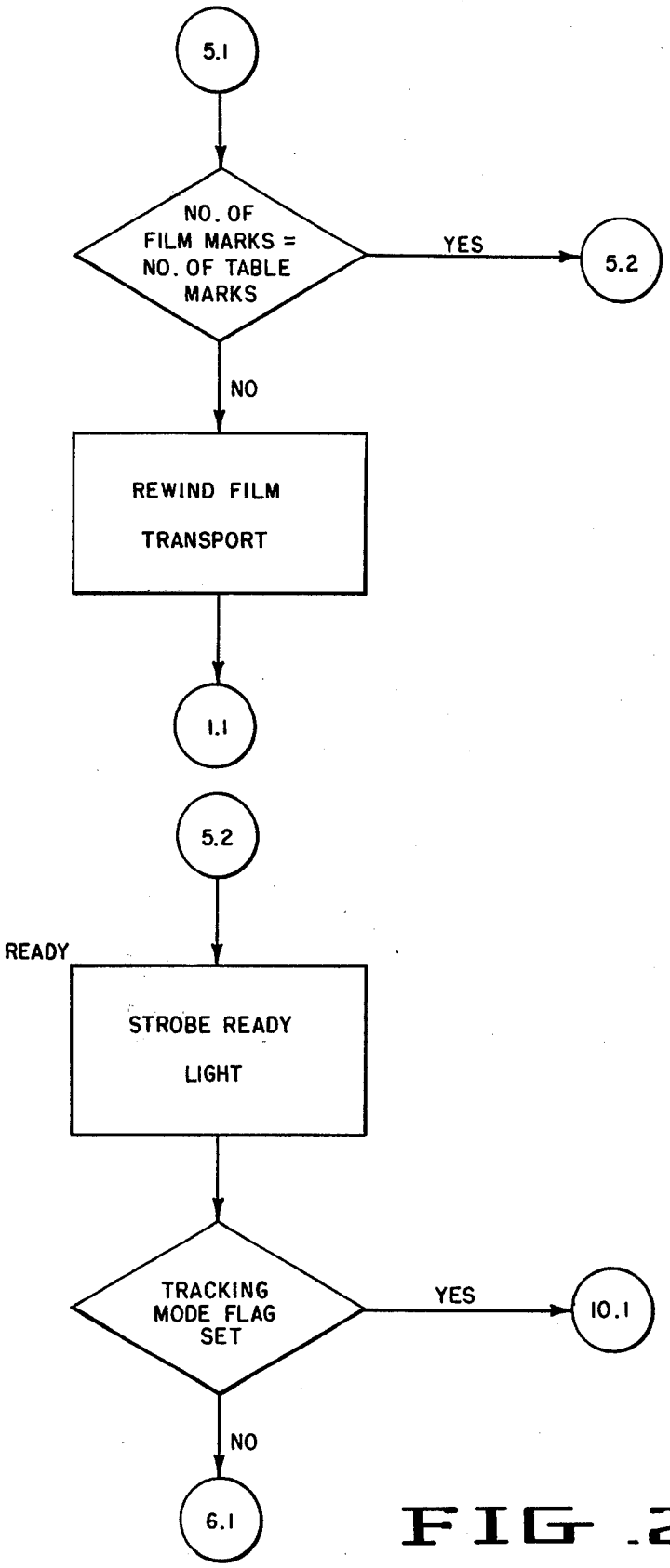
Figure 23F:
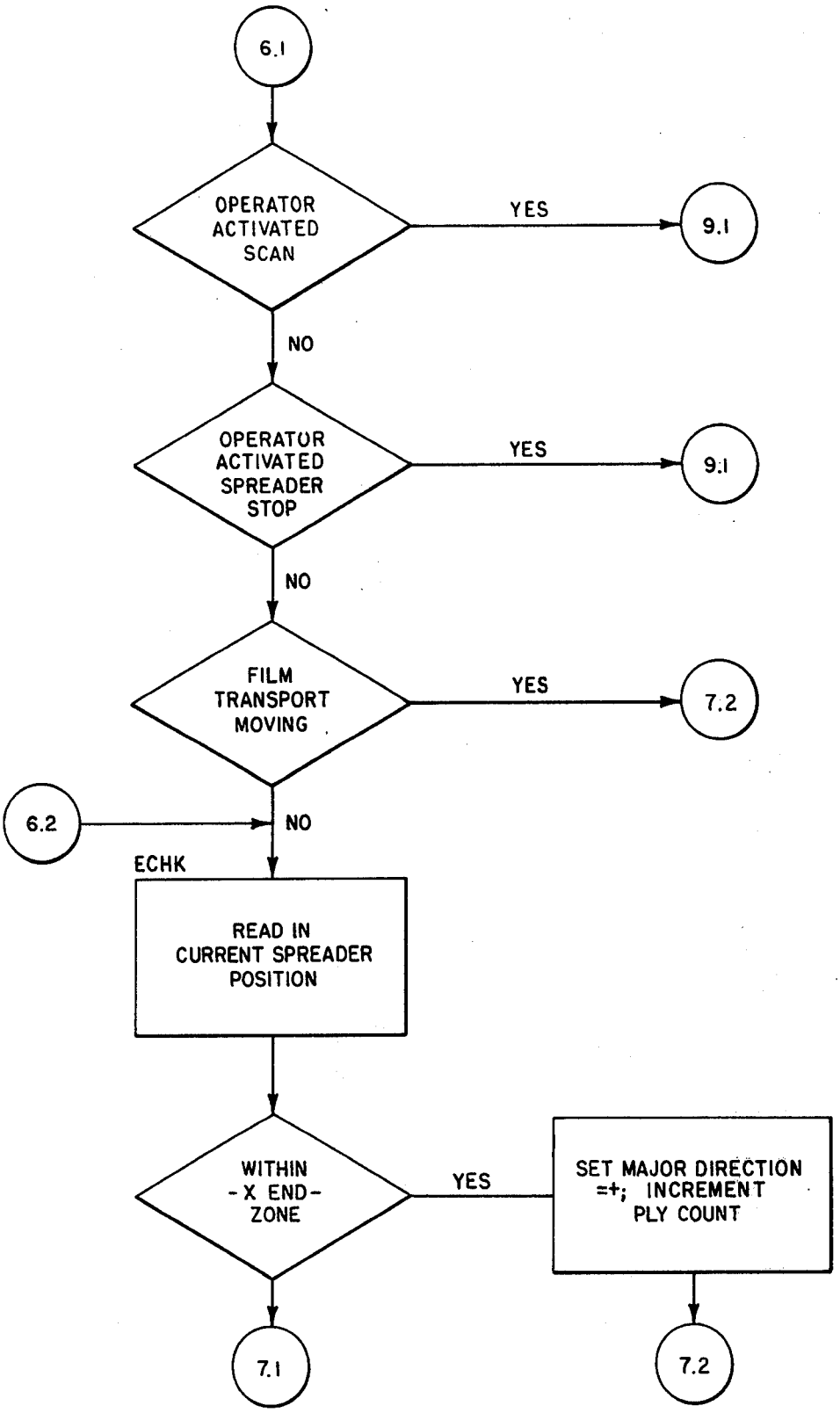
Figure 23G:
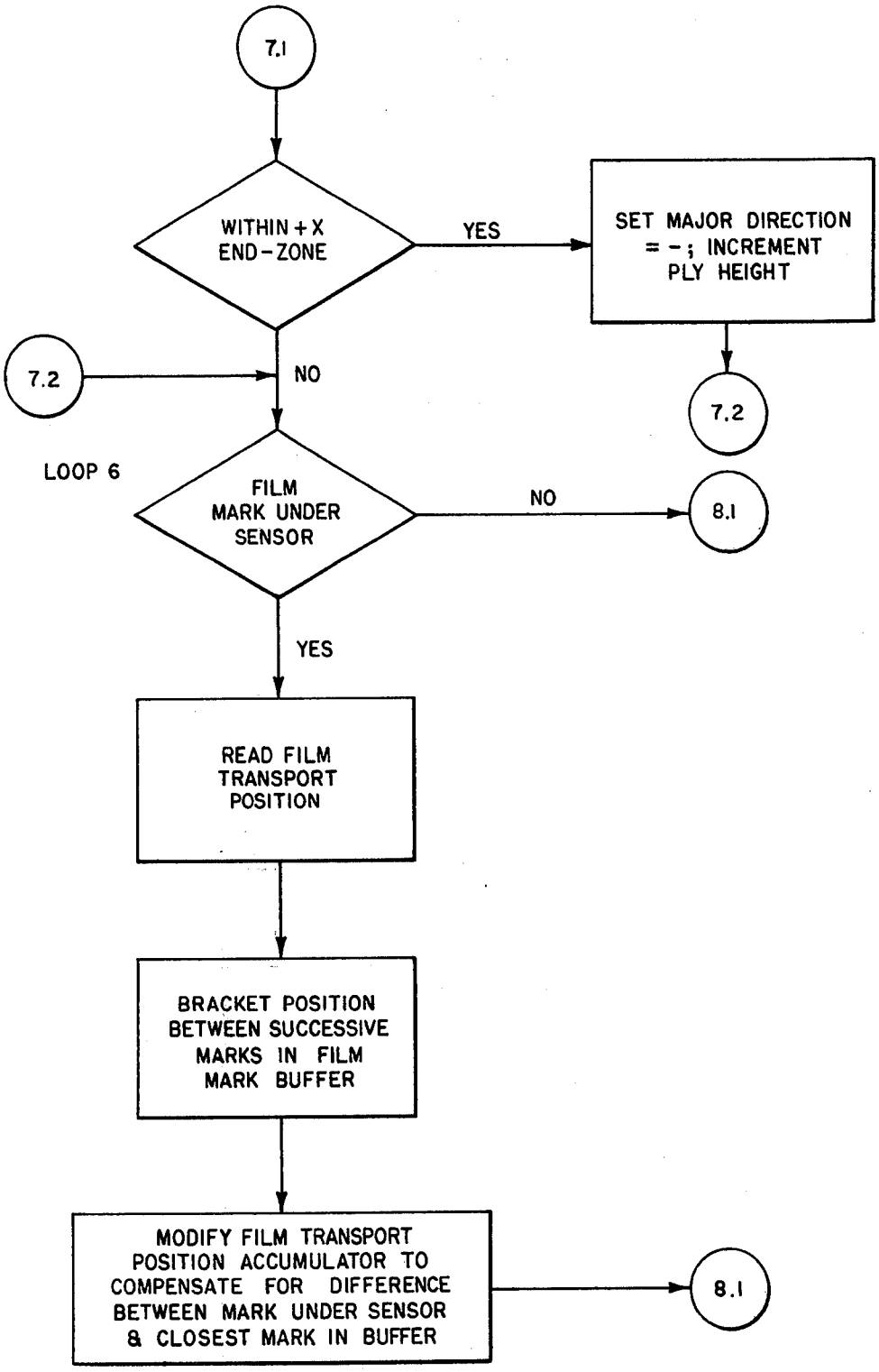
Figure 23H:
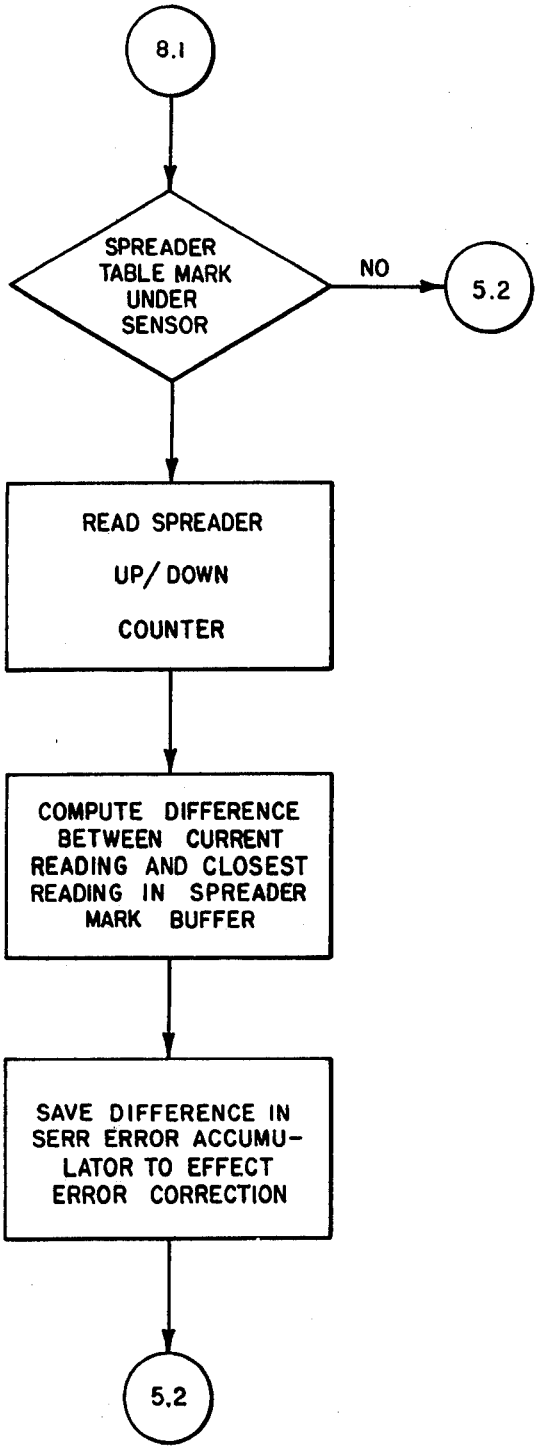

The Ready Loop phase of the program continuously reads the spreader table motion encoder up/down counter 170 to determine when one of the "end-zones" is entered by the spreader (see FIG. 23F). It is in this fashion that the program keeps track of the "major direction" of the spreader. The "major direction" is changed to +X whenever the program detects that the spreader is within the −X "end-zone" and similarly, the program switches the "major direction" to X when it detects that the spreader is in the +X "end-zone". The "major direction" is used for several things within the program logic including proper setting of the prism and for computing the position to which the film transport must be driven for viewing. Also each time the major direction is changed, the ply-height is incremented. (See FIG. 23F).

Tracking Logic Section: (See FIGS. 23I–23J)

The Tracking Logic Section is initiated whenever the operator presses the scan switch 202, the stop button on the spreader, or gets a signal from the spreader scanner (see FIG. 23F). It is within the section that the program computes the position to which the film transport must be advanced. Once the computation is made, the commands are issued to the film transport 225, 72 so that it will proceed to move to the computed position. As long as the program remains in the "tracking mode", the computation is repeated and the position of the transport is updated continually.

The information below describes how the the desired film transport position is determined from the inputs listed in the previous paragraph.

Figure 23I:
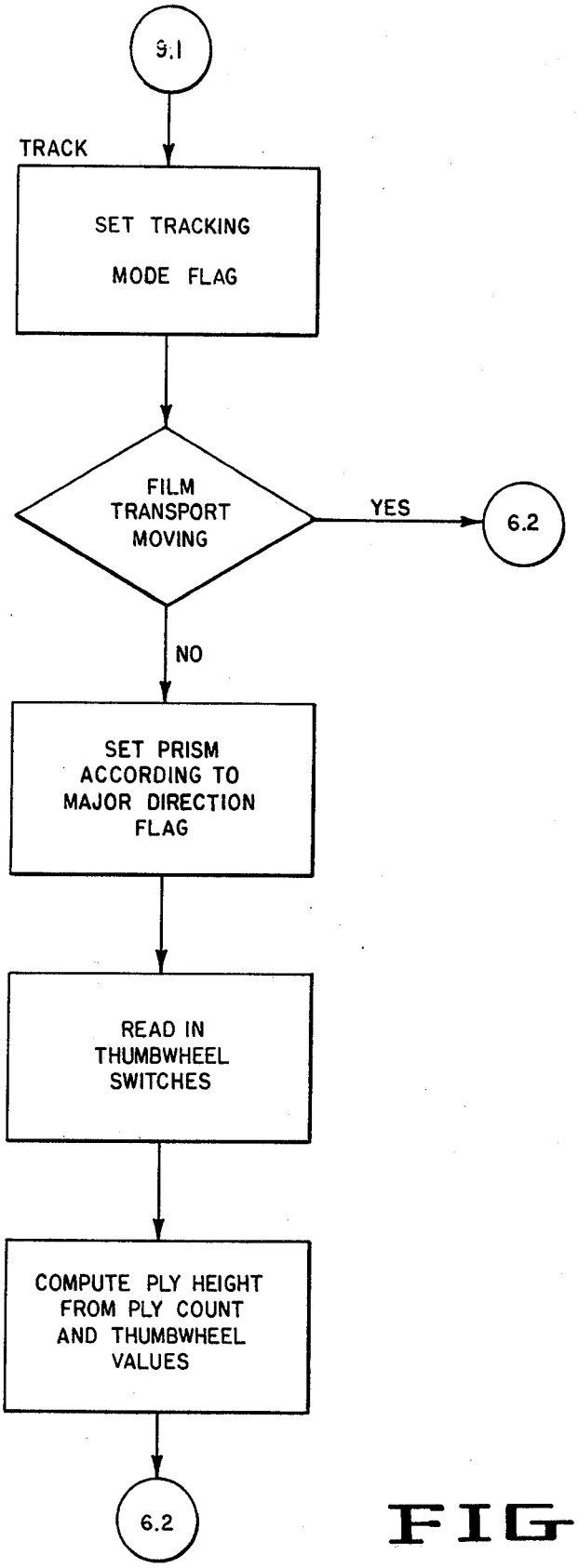
Figure 23J:
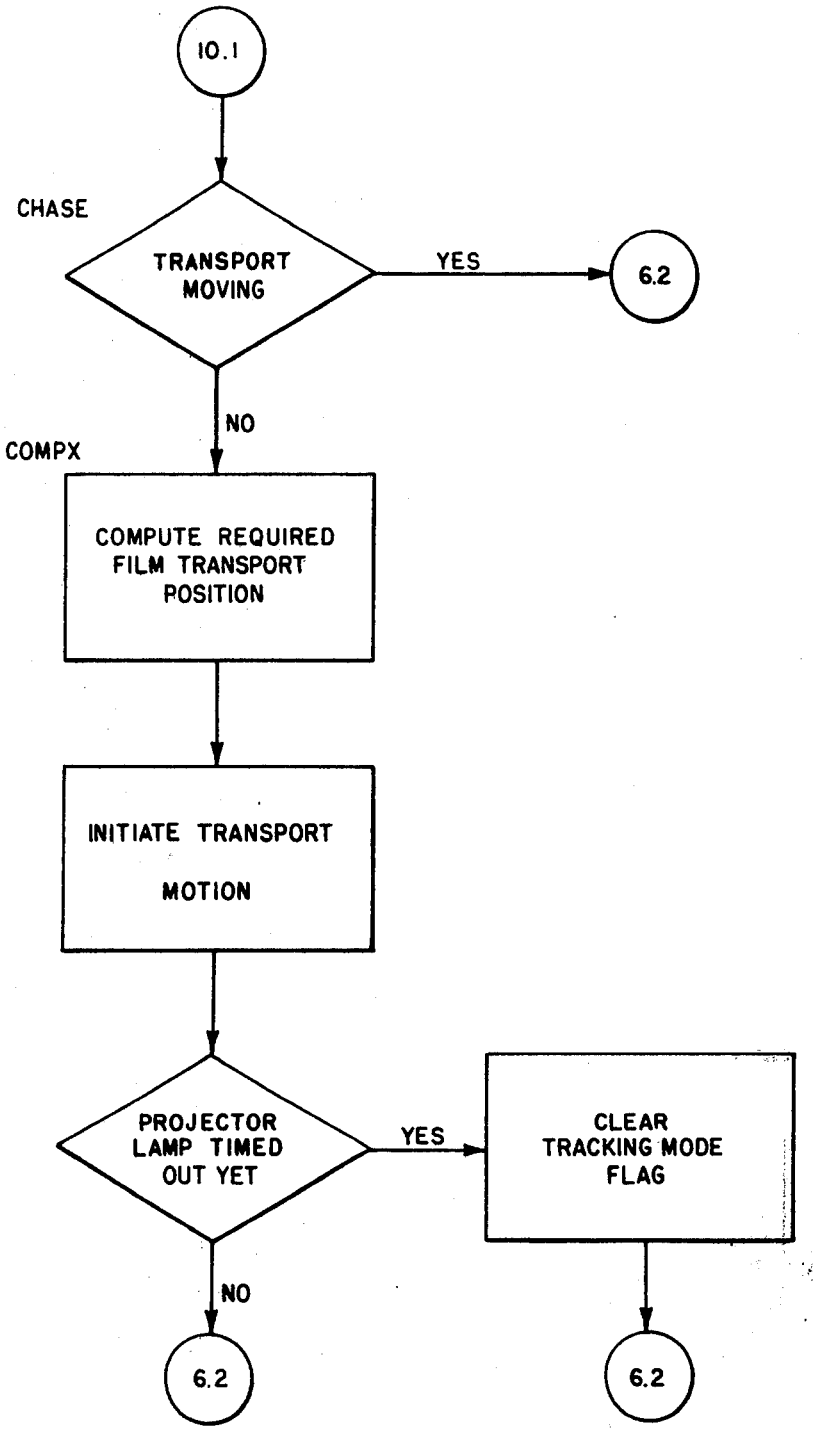
Figure 23K:
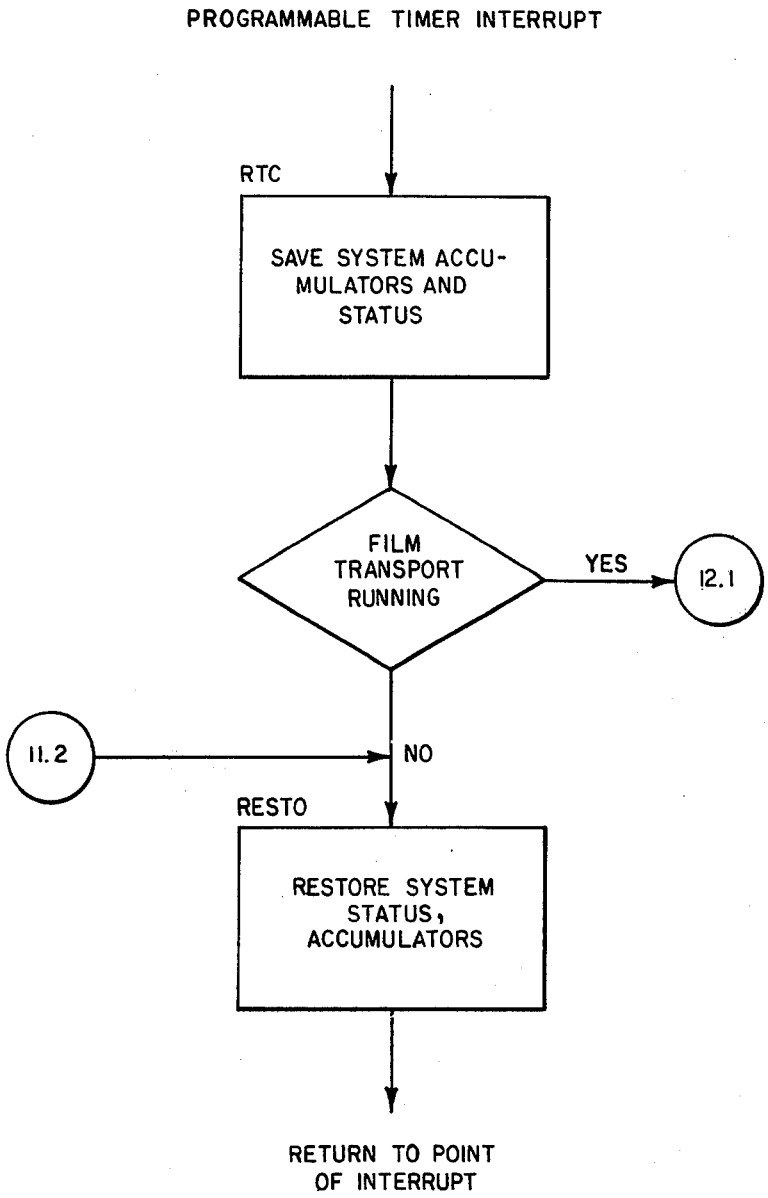
Figure 23L:
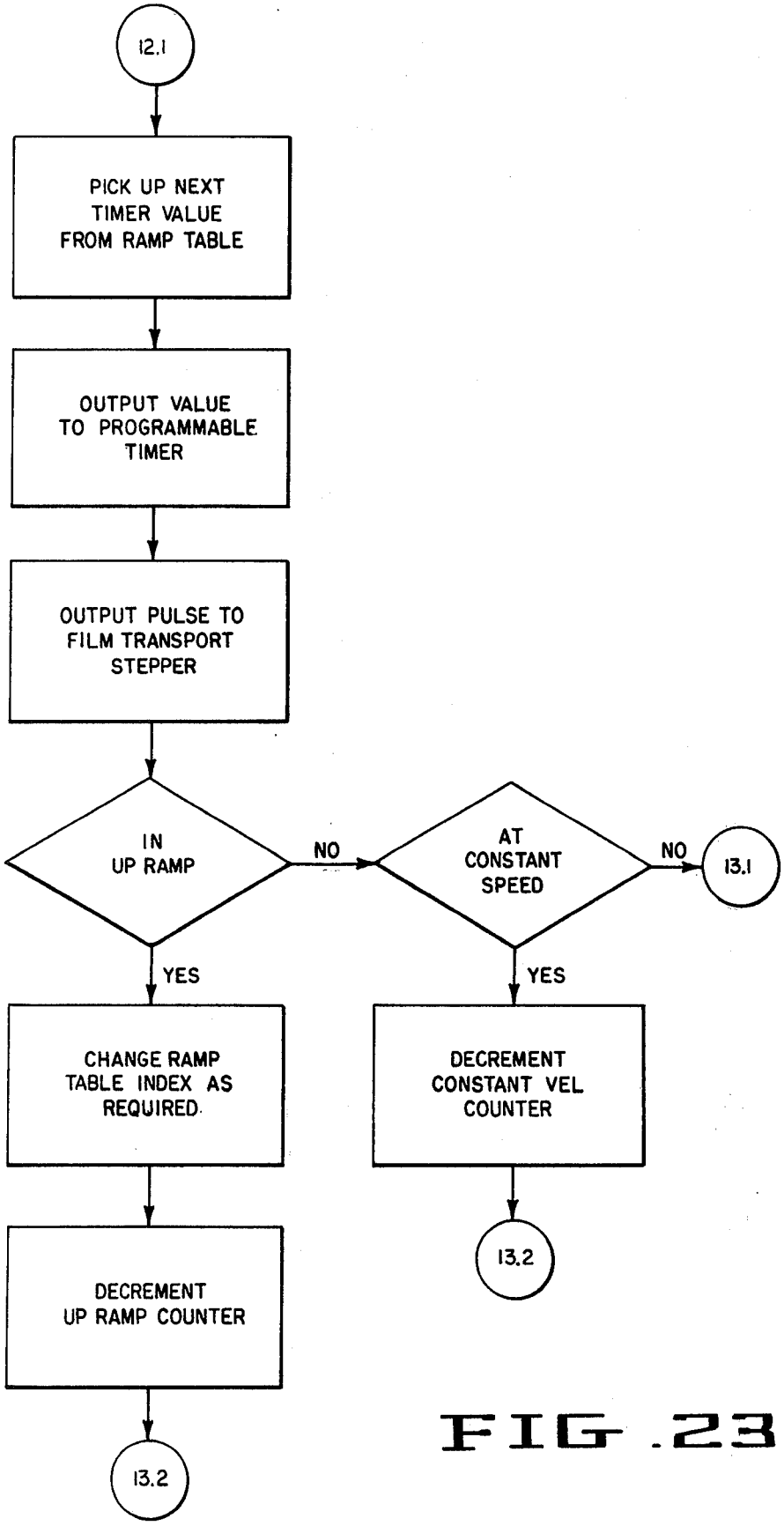
Figure 23M:
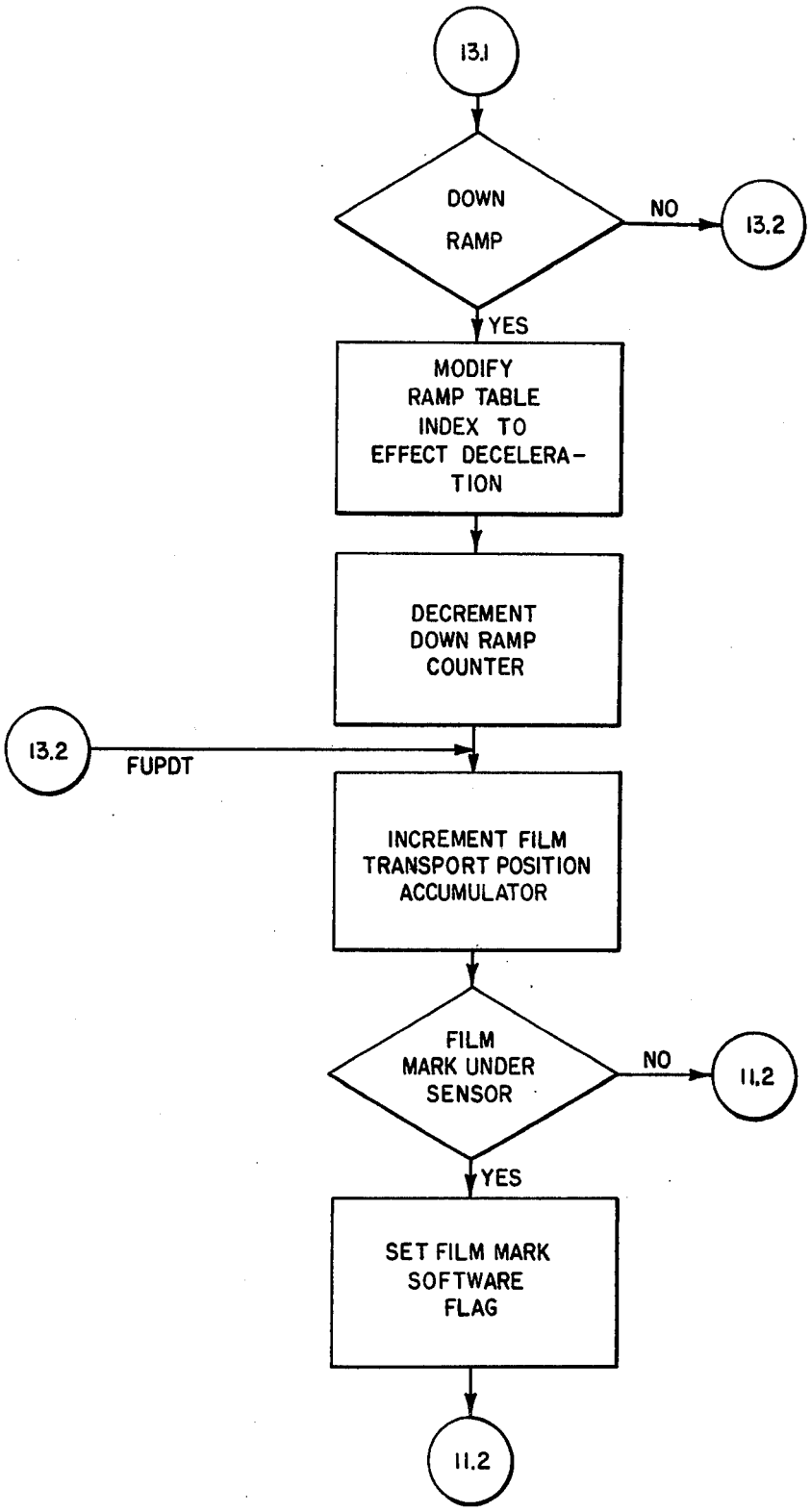

The following data items are inputs to the calculation required to compute the film transport position:

A. Current reading from spreader motion up/down counter 170 (FIG. 23F).
B. Major direction 210.
C. Ply count. (FIG. 23I).
D. Ply density (from thumbwheel switches 212). (FIG. 23I).
E. Offset from spreader table mark sensor to position on spreader table directly below vertical drop 18 of cloth. (Constant).
F. Vertical drop distance 18 measured from projection center down to spreader table. (Constant).
G. Table of spreader mark positions as collected in CAL run.
H. Table of film mark positions as collected in CAL run.

The computation requires several steps as described generally below:

1. Adjust "A" using "E". Necessary since values in "G" are similarly adjusted.
2. Compute ply height by multiplying ply count ("C") by ply density ("D").
3. Compute an adjusted vertical drop by substracting ply height from "F".
4. Using the result from Step No. 1, compute another intermediate value by adding or subtracting the adjusted vertical drop (Step No. 3). The decision to add or subtract is made using the current major direction ("B").
5. Compare intermediate value from step No. 4 to table "G" determining the value in the table just smaller. Compute offset distance to this table value.
6. Compute the desired film transport position by adding the offset value from step No. 5 to the value from table "H" which corresponds to the "just smaller" table "G" value.

Interrupt Processing: (See FIGS. 23K–23M)

The Interrupt Processing logic within the program is executed each time an interrupt is received from the MPS programmable down counter (clock) 190. The clock may be programmed to interrupt at intervals which are a multiple of microseconds. The basic purpose served by the clock 190 is a time base for generating pulses of a known frequency to the film transport stepper motor 72. The Interrupt Processing logic also contains logic for generating acceleration and deceleration ramps to the film transport stepper motor 72.

Since there is no hardware accumulator for film transport stepper pulses (or position), this function is provided by the software within the Interrupt Processing logic. To accomplish this is simply a matter of keeping a running total of the pulses issued to the film transport stepper motor, adding pulses to the accumulator when the direction is positive and subtracting pulses from the accumulator when the direction is negative.

When the main line MPS program detects a need to advance the film transport, all that is required is to set up three counters within the software. As soon as these counters are set up, the Interrupt Processing logic automatically proceeds to use the three counters as a film transport up ramp, constant velocity count, and down ramp.

Error Detection Routines:

In the system Ready Loop, the presence of spreader table marks and film marks are constantly monitored. When either is detected, the current position of the spreader (or film transport) is examined. In either case, the closest mark within the appropriate table of table marks or film marks is determined. The difference between the currently detected position of the mark and the position of the closest mark within the corresponding table is then assumed to be an accumulated error and compensation is made to correct for the error (see FIGS. 23G, 23H). In the case of the film transport, the compensation is made by simply modifying the software accumulator for the film transport position. If the correction needs to be made to the spreader position, since the accumulator is in the hardware, the correction is made by storing an appropriate value in a software "error accumulator". This "error accumulator" is then included in the computation of the film transport position from the current spreader position (refer to the tracking logic section).

Double Byte Math & Miscellaneous Utility Routines:

The following utility routines are provided to support the needs of the MPS programs.

1. Double precision signed subtract.
2. Double precision unsigned subtract.
3. Double precision add.
4. Double precision twos complement.
5. Double precision shift right.
6. Double-byte integer divide.
7. Double-byte integer multiply.
8. BCD to binary conversion routine.

The terms and expressions which have been employed here are used as terms of description and not of limitation, and there is no intention, in the use of such terms and expressions, of excluding eqivalents of the features shown and described, or portions thereof, it being recognized that various modifications are possible within the scope of the invention claimed.

What is claimed is:

1. Improved apparatus for correlating the position of fabric flaws with the location of a cutting pattern for the fabric so that an operator can visually determine if the cutting pattern overlaps the flaws, wherein the apparatus is of the type which simultaneously spreads the fabric on a planar surface while projecting the pattern from a film onto the spread fabric and the improvement comprises:

a film of a reduced scale image of the pattern to be cut out;

a projector for projecting portions of the pattern on the film onto selected portions of the fabric;

an $x$–$y$ carriage mounting for the projector so that the projector is movable over the length and width of the fabric spread on the planar surface;

film indexing means to selectively advance the film lengthwise through the projector in correspondence with the projector's position along the length of spread fabric;

a gear and slide assembly for interconnecting the film and projector relative to the $x$–$y$ carriage so that as the projector and film are moved across the width of the fabric in one direction and at a first velocity the gear assembly moves the projector relative to the film in the opposite direction and at a second velocity which has the same ratio to the first velocity as the scale of the film image pattern has to the actual size pattern; with the resulting effect being that the portions of the pattern on the film which are projected onto the fabric appear to the operator to have a fixed position relative to the fabric.

2. Pattern correlation apparatus as recited in claim 1, wherein the projector projects the pattern on the film onto the face side of the cloth as it is dropped vertically from the spreader onto the planar surface and the projector includes a movable prism for reversing the projected image about an axis parallel to the width of the planar surface whereby the pattern can be sequentially projected in aligned fashion on the face side of each layer of a stack of layers of the material as they are laid from the spreader alternately face up face down.

3. Pattern correlation apparatus as recited in claim 2, wherein the film indexing means includes means for automatically adjusting for the increasing height of the stack of layers of material, as they are spread on the planar surface, when indexing the film.

4. Pattern correlation apparatus as recited in claim 1, wherein the planar surface has markings along its length which are representative of portions of predetermined lengths of the fabric to be spread, the film has markings spaced along its length, and wherein the film indexing means includes a first sensor-counter for sensing and counting the planar surface markings as the first carriage is moved over the planar surface, a second sensor-counter for sensing and counting the film markings, a micro-computer for electronically correlating discrete portions of the film, as represented by the markings along its length counted by the second sensor-counter, with respect to the markings on the planar surface sensed and counted by the first sensor-counter during an initialization run of the first carriage along the planar surface, and motor means operated by the micro-computer for selectively indexing the film in the direction of its length by a distance representative of the number of planar surface markings sensed and counted.

* * * * *